US008578585B2

(12) United States Patent
Dettloff

(10) Patent No.: US 8,578,585 B2
(45) Date of Patent: Nov. 12, 2013

(54) METHOD OF MANUFACTURING A MODULAR RANGE SYSTEM

(75) Inventor: Stan Dettloff, Kings Mountain, NC (US)

(73) Assignee: Illinois Tool Works Inc., Glenview, IL (US)

( * ) Notice: Subject to any disclaimer, the term of this patent is extended or adjusted under 35 U.S.C. 154(b) by 448 days.

(21) Appl. No.: 12/860,614

(22) Filed: Aug. 20, 2010

(65) Prior Publication Data

US 2011/0041831 A1 Feb. 24, 2011

Related U.S. Application Data

(63) Continuation-in-part of application No. 12/034,223, filed on Feb. 20, 2008, now Pat. No. 8,424,512.

(60) Provisional application No. 60/977,228, filed on Oct. 3, 2007, provisional application No. 60/890,646, filed on Feb. 20, 2007.

(51) Int. Cl.

| | |
|---|---|
| ***B21D 39/00*** | (2006.01) |
| ***F24C 3/08*** | (2006.01) |
| ***F24C 15/30*** | (2006.01) |

(52) U.S. Cl.

USPC .... 29/469; 29/525.01; 29/525.02; 29/525.11; 126/39 B; 126/9 R; 126/19 R

(58) Field of Classification Search

USPC ..... 29/469, 525.01, 525.02, 525.11; 126/39 B, 9 R, 9 B, 19 R, 273 R, 333; 108/157.13

See application file for complete search history.

(56) References Cited

U.S. PATENT DOCUMENTS

| | | | | |
|---|---|---|---|---|
| 1,991,573 | A | | 2/1935 | Pickup |
| 2,888,544 | A | * | 5/1959 | Kesling ..... 219/452.13 |
| 3,033,188 | A | | 5/1962 | Cline et al. |
| 3,474,724 | A | | 10/1969 | Jenn |
| 3,746,417 | A | | 7/1973 | Sasnett |
| 3,797,375 | A | | 3/1974 | Cerola |
| 4,042,806 | A | | 8/1977 | McCartney |
| 4,245,615 | A | | 1/1981 | Moss |
| 4,409,954 | A | | 10/1983 | Berlik et al. |
| 4,413,610 | A | | 11/1983 | Berlik |
| 4,457,293 | A | | 7/1984 | Berlik |
| 5,190,026 | A | | 3/1993 | Doty |
| 5,249,567 | A | | 10/1993 | Maitland et al. |
| 5,775,316 | A | | 7/1998 | Jones |
| 6,148,812 | A | | 11/2000 | Taplan et al. |
| 6,230,701 | B1 | | 5/2001 | Schultheis et al. |
| 6,877,825 | B2 | | 4/2005 | Khosropour et al. |
| 6,905,332 | B1 | | 6/2005 | Neal et al. |
| 2003/0227240 | A1 | | 12/2003 | Khosropour et al. |
| 2006/0049725 | A1 | | 3/2006 | Simon |
| 2008/0202493 | A1 | | 8/2008 | Detloff |

* cited by examiner

FOREIGN PATENT DOCUMENTS

| | | |
|---|---|---|
| GB | 2311128 | 9/1997 |
| WO | WO 2004/062444 | 7/2004 |
| WO | WO 2004062444 A2 * | 7/2004 |

OTHER PUBLICATIONS

PCT, International Search Report and Written Opinion, International Application No. PCT/US2011/046564 (Feb. 17, 2012).

*Primary Examiner* — Jermie Cozart

(74) *Attorney, Agent, or Firm* — Thompson Hine LLP

(57) ABSTRACT

A modular range system and method utilizes a plurality of substantially pre-assembled range modules configured to be interconnected together, using combination kits, such that a variety of range configurations can be achieved using a relatively small number of stocked substantially pre-assembled range modules.

9 Claims, 23 Drawing Sheets

METHOD OF MANUFACTURING A MODULAR RANGE SYSTEM

CROSS-REFERENCES

This application is a continuation-in-part of U.S. application Ser. No. 12/034,223, filed Feb. 20, 2008, which in turn claims the benefit of U.S. provisional application Ser. No. 60/977,228 filed Oct. 3, 2007 and U.S. provisional application Ser. No. 60/890,646 filed Feb. 20, 2007. The entirety of each aforesaid application is incorporated herein by reference.

TECHNICAL FIELD

This application relates generally to a modular system for manufacturing a line of range products having a variety of widths and a variety of top cooking configurations.

BACKGROUND

Restaurant ranges are available in a variety of sizes and cooktop configurations. Some ranges may have only a single cooking system type, while others may include two or more cooking system types. To satisfy the needs of the market, range manufacturers typically provide a full line of range sizes and cooktop configurations, which increases manufacturing complexity and cost. The most common types of cooking system types include open top burners, manual griddle, thermostatic griddle, step-up rear burner, raised griddle/broiler and charbroiler. As commonly used in the industry, and as used herein, the term "range" includes, without limitation, units having one or more of the foregoing cooking system types.

It would be desirable to provide a versatile method of producing a full line of range units. It would also be desirable to provide range units that are readily modified in the field to provide different cooktop configurations.

SUMMARY

In one aspect, a method of manufacturing a range unit involves: (a) stocking a first substantially pre-assembled range module having a first width and first top configuration; (b) stocking a second substantially pre-assembled range module having a second width and second top configuration; (c) to fill an order for a range having a third width and third top configuration, where the third width is equal to the sum of the first width and the second width and the third top configuration is a combination of the first top configuration and the second top configuration, (i) placing the first substantially pre-assembled range module adjacent the second substantially pre-assembled range module; and (ii) rigidly connecting the first substantially pre-assembled range module adjacent the second substantially pre-assembled range module using interconnecting structure located on the range modules to form a combined assembly.

In another aspect, a method of manufacturing range units of a variety of configurations involves: (a) stocking a first substantially pre-assembled range module having a first width and first top configuration; (b) stocking a second substantially pre-assembled range module having a second width and second top configuration; (c) stocking a third substantially pre-assembled range module having the second width and a third top configuration; (d) to fill an order for a range having a third width and a fourth top configuration, where the third width is equal to the sum of the first width and the second width and the fourth top configuration is a combination of the first top configuration and the second top configuration, (i) placing the first substantially pre-assembled range module adjacent the second substantially pre-assembled range module; (ii) rigidly connecting the first substantially pre-assembled range module adjacent the second substantially pre-assembled range module using interconnecting structure located on the range modules to form a first combined assembly; (e) to fill an order for a range having the third width and a fifth top configuration, where the third width is equal to the sum of the first width and the second width and the fifth top configuration is a combination of the first top configuration and the third top configuration, (i) placing the first substantially pre-assembled range module adjacent the third substantially pre-assembled range module; (ii) rigidly connecting the first substantially pre-assembled range module adjacent the third substantially pre-assembled range module using interconnecting structure located on the range modules to form a second combined assembly.

In a further aspect, a range unit has a defined width and is formed by a first range module and a second range module. The first range module has a first width and interconnecting structure along at least a first side of the first range module. The second range module has a second width and interconnecting structure along at least a first side of the first range module. The first side of the first range module is located adjacent the second side of the second range module with interconnecting structure of the first range module aligned with and linked to interconnecting structure of the second range module. A sum of the first width and the second width is substantially the same as the defined width.

Other range unit configurations achieved via the manufacturing process are also provided.

DETAILED DESCRIPTION

Figure 1:
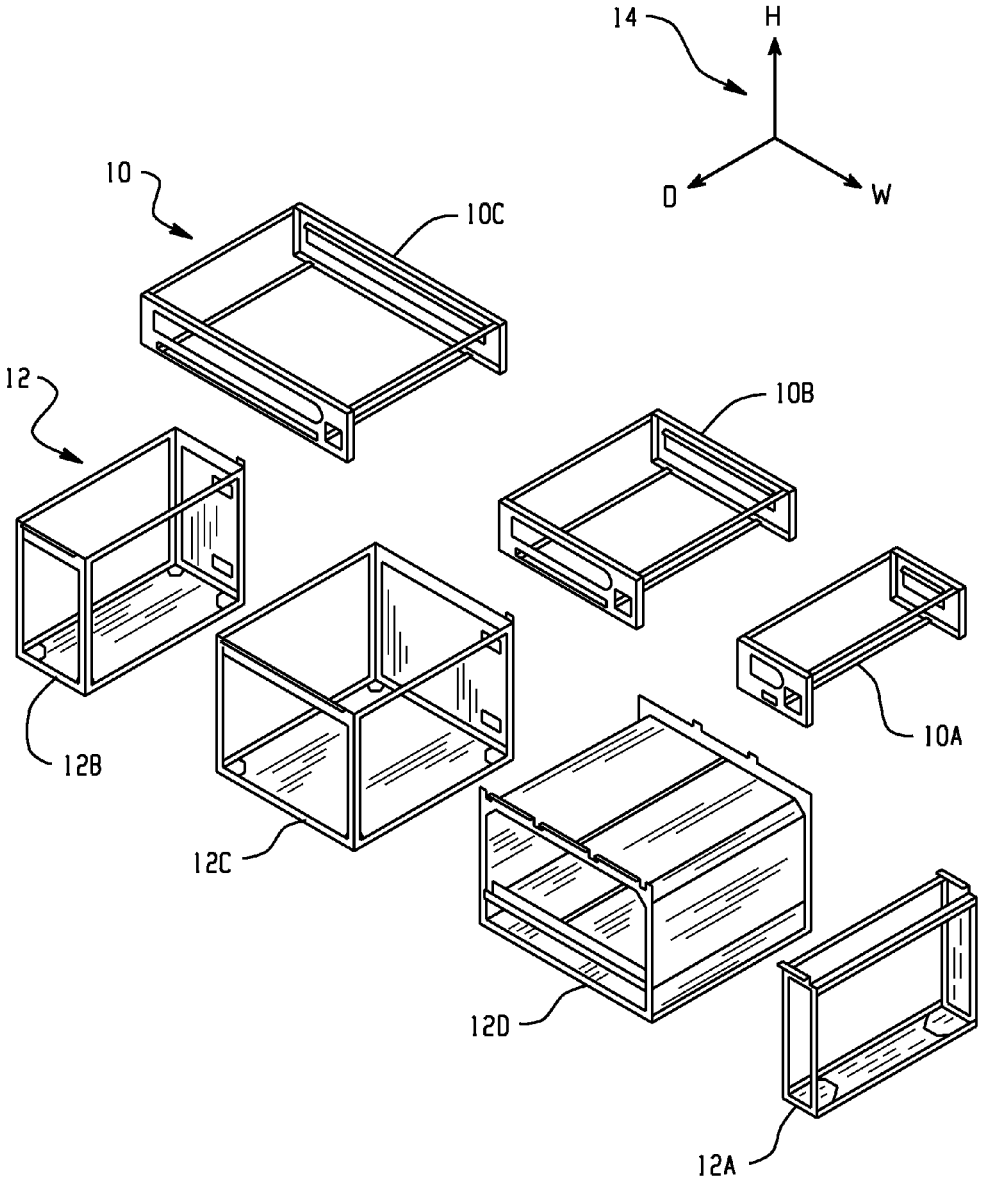
FIG. 1 illustrates the top and base frame units in accordance with one implementation of a modular range frame system.

Referring to FIG. 1, one embodiment of a range frame system is shown, including a plurality of top frame units 10 and a plurality of base frame units 12. The top frame units 10A-10C have a common height (H) and depth (D), but different widths (W), where such dimensions are defined in the direction of the illustrated coordinate system 14. In one implementation, the width of top frame unit 10A may be 12", the width of top frame unit 10B may be 24" and the width of top frame unit 10C may be 36". The base frame units 12A-12D have a common height and depth, but different widths. In one implementation, the width of base frame unit 12A is 6", the width of base frame unit 12B is 12", the width of base frame unit 12C is 24" and the width of base frame unit 12D is 30". The frame system can advantageously be utilized to manufacture a variety of range sizes and configurations as will now be described. While the following discussion focuses on the use of cooktop units and base units formed in part by frames, it is recognized that a similar system could be implemented in which the cooktop units and base units are manufactured from some form of non-frame technique, and thus the scope of the disclosure embodied herein, and various features detailed, applies similarly to cooktop units and base units of non-frame construction.

Figure 2:
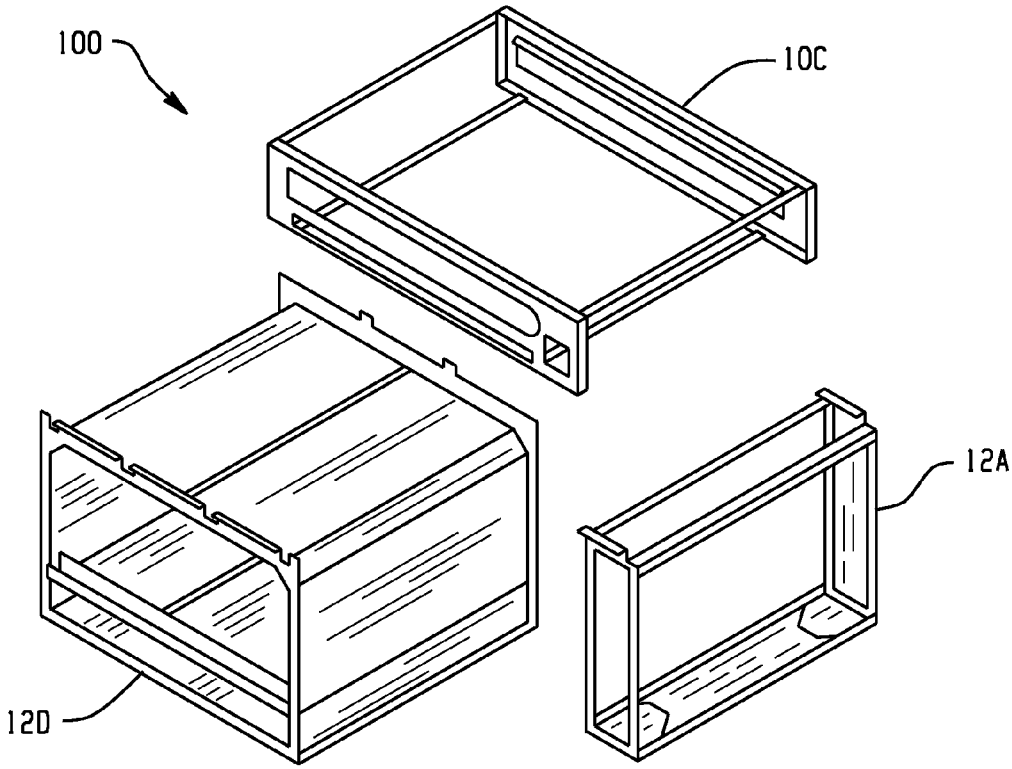
FIGS. 2 and 3 show frame exploded and frame assembled views of one range unit configuration.
Figure 3:
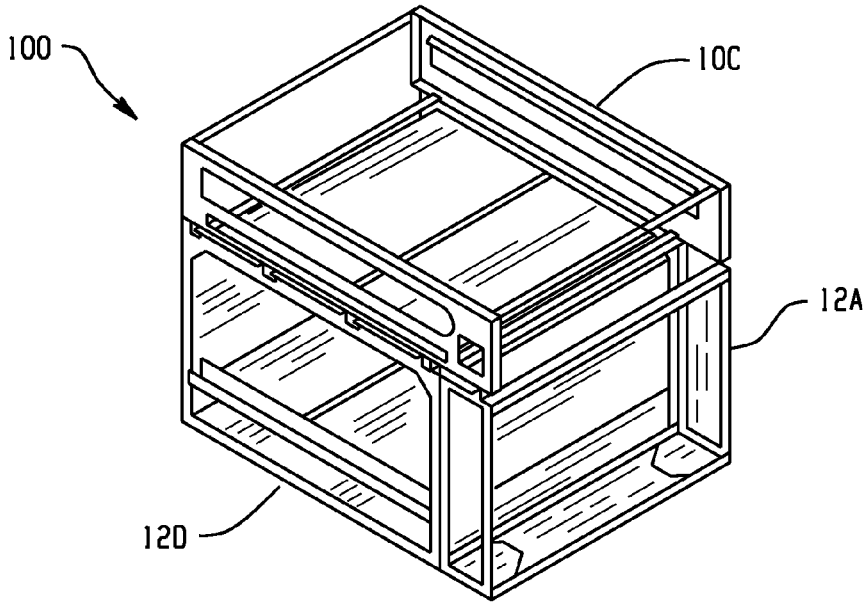

Referring to FIGS. 2 and 3 a range unit configuration 100 is shown in frame exploded and frame assembled views, where the top frame assembly is formed by top frame unit 10C and the base frame assembly is formed by joined base frame units 12A and 12D. In this configuration the width of the range unit 100 is the same as the width of the top frame unit 10C, and the combined width of base frame units 12A and 12D is the same as the width of top frame unit 10C. In one implementation configuration 100 is a 36" wide range unit.

Figure 4:
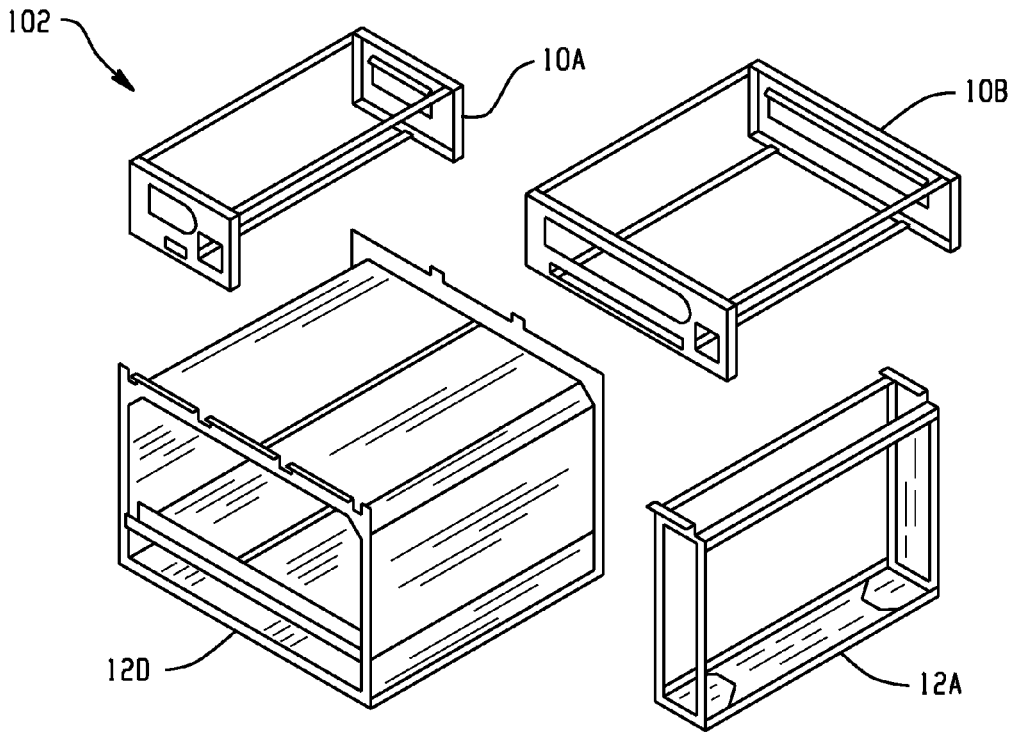
FIGS. 4 and 5 show frame exploded and frame assembled views of another range unit configuration.
Figure 5:
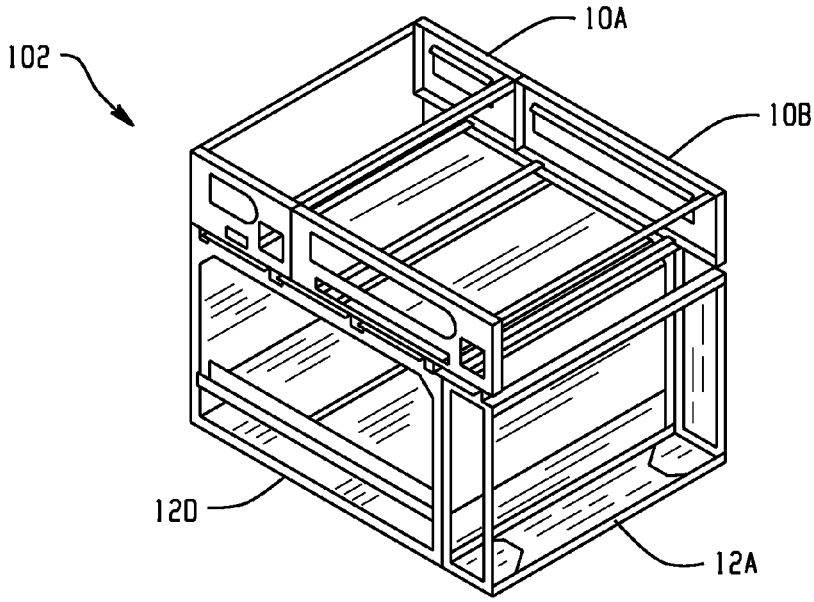

FIGS. 4 and 5 illustrate another range unit configuration 102 in which the top frame assembly is formed by top frame units 10A and 10B, and the base frame assembly is formed by joined base frame units 12A and 12D. Range unit 102 has the same width as range unit 100, but is different in the configuration of the top frame assembly. Range unit configuration 100 is used to produce a unit has only a single top cooking system type (e.g., only open top burners or only charbroiler or only manual griddle), and range unit configuration 102 is used to produce a unit that has two different top cooking system types (e.g., open top burner next to manual griddle or open top burner next to charbroiler or thermostatic griddle next to charbroiler).

In this regard, each of the top frame units 10A, 10*b* and 10C may be preassembled (in the same plant or at another location and shipped to the assembly plant) with a specific top cooking system type before being mounted on the base frame assembly during the manufacturing process. In this manner, when an order for a range unit of specific size and cooktop configuration is received, the appropriate preassembled top frame units may be selected and then mounted to the base frame assembly. Thus, in the range manufacturing/assembly plant, a supply of preassembled top frame units may stocked and ready for use when an order comes in. The number of each type of preassembled top frame unit maintained in stock ready for assembly may be set in accordance with the demand for different range configurations (e.g., if range units that will require a 12" width open top burner section are typically ordered at a rate that is three times greater than range units that will require a 12" width charbroiler, then the maintained stock of top frame units 10A preassembled with open top burners may be three times the maintained stock of top frame units 10A preassembled with a charbroiler). However, it is also recognized that the preassembly of the top frame units may occur in the manufacturing/assembly facility itself in response to a customer order. Accordingly, as used herein the term "preassembled" when referring to a top frame unit and a cooking system types is intended to refer to assembly of the cooking system type into the top frame unit prior to mounting the top frame unit on the base frame assembly.

The base frame units 12D and 12C may be preassembled as a standard oven or as a convection oven. Typically, the base frame unit 12A can be used, and in some cases preassembled, as a control panel for the range unit. Base frame unit 12B may be used primarily as a cabinet, though incorporating controls or standard or convection oven technology into such units is possible.

Figure 6:
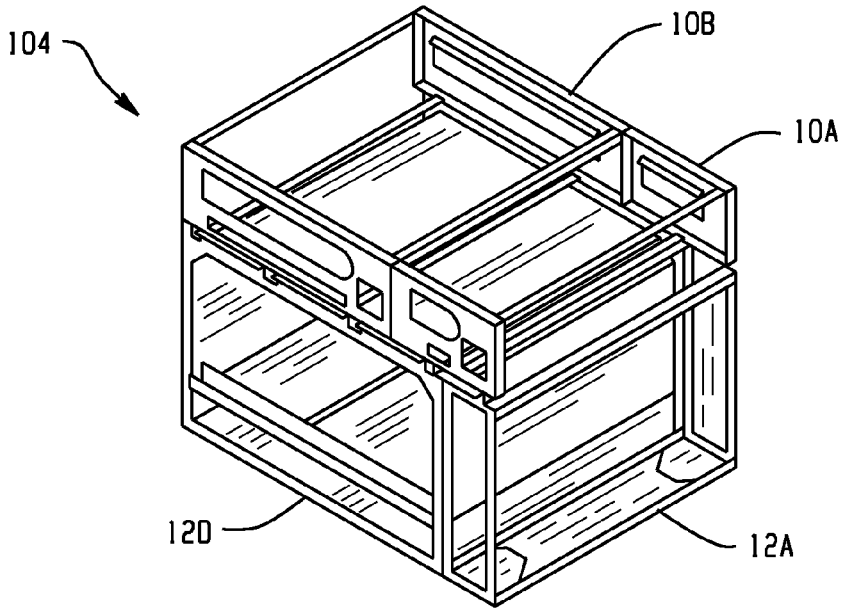
FIG. 6 shows a frame assembled view of another range unit configuration.

Referring now to FIG. 6, a range unit configuration 104 is illustrated that uses the same frame units as range unit configuration 102 (FIGS. 4 and 5), but reverses the position of the top frame units 10A and 10B. So, for example, range unit 102 could represent a configuration with a 24" width of open top burners located to the right of a 12" width manual griddle, and range unit 104 could represent a configuration with a 24" width of open top burners located to the left of a 12" width manual griddle. Providing this type of variability facilitates accommodation of the large variety of needs that are requested in the range market based upon kitchen configuration and chef preference.

Figure 7:
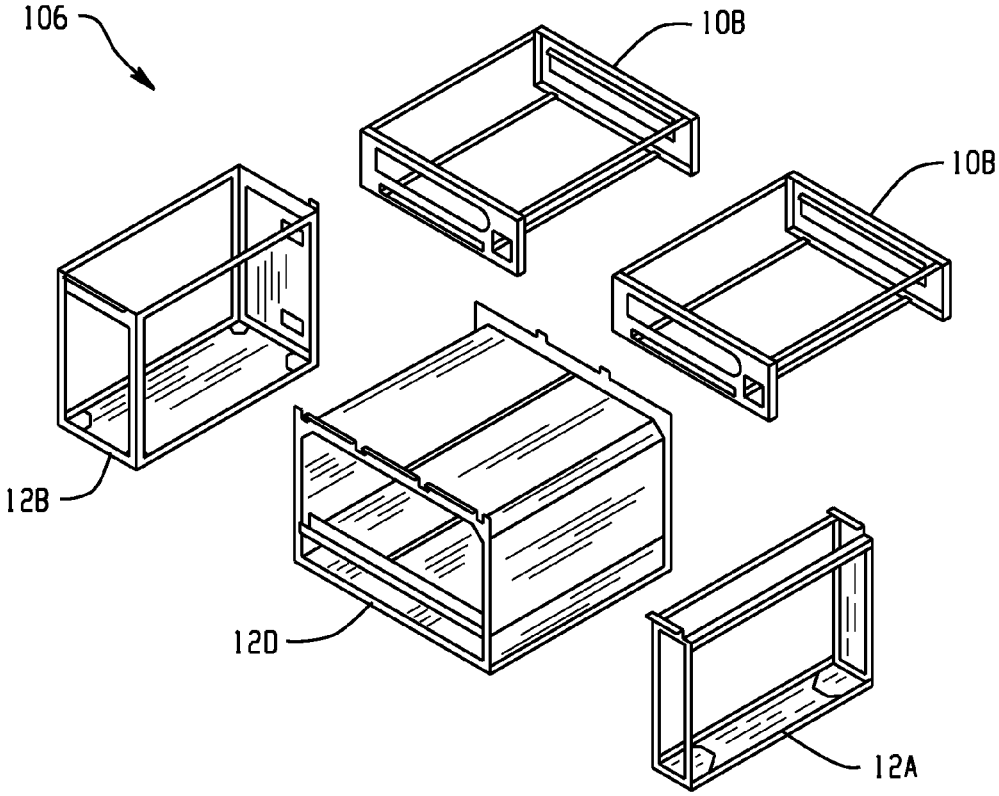
FIGS. 7 and 8 show frame exploded and frame assembled views of another range unit configuration.
Figure 8:
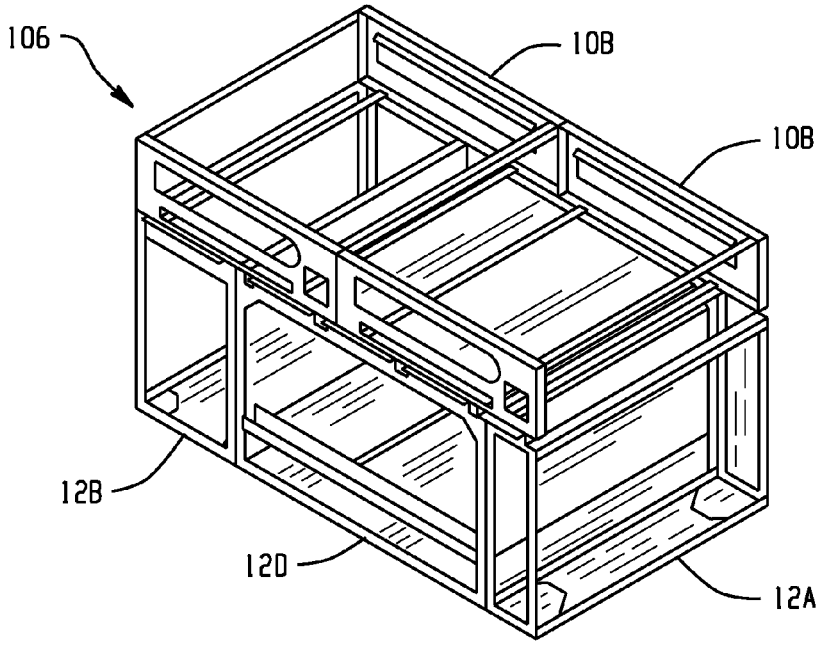

FIGS. 7 and 8 illustrate a range unit configuration 106 in which the to frame assembly is made up of two top frame units 10B and the base frame assembly is made up of joined base frame units 12A, 12B and 12D. The two top frame units 10B could be preassembled with the same type cooking system or with respective different type cooking systems as needed. In one implementation range unit 106 is a 48" wide range unit.

Figure 9:
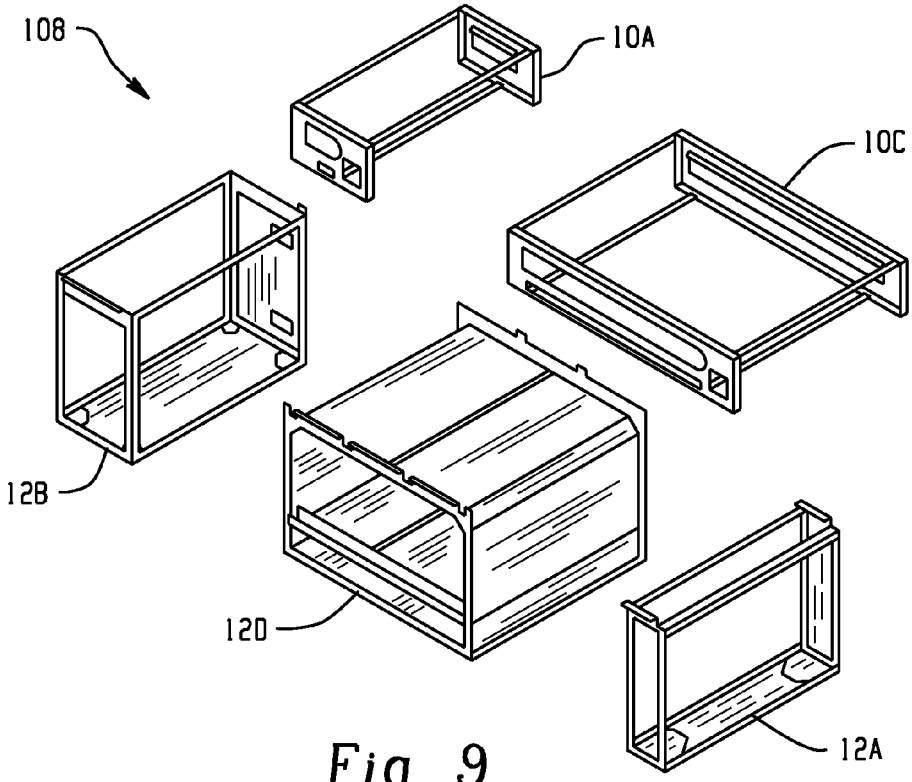
FIGS. 9 and 10 show frame exploded and frame assembled views of another range unit configuration.
Figure 10:
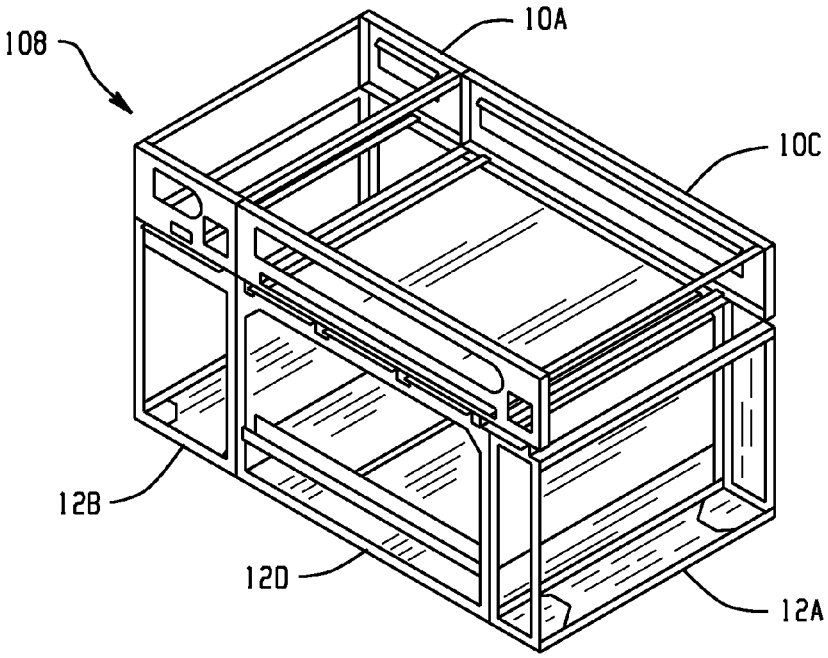
Figure 11:
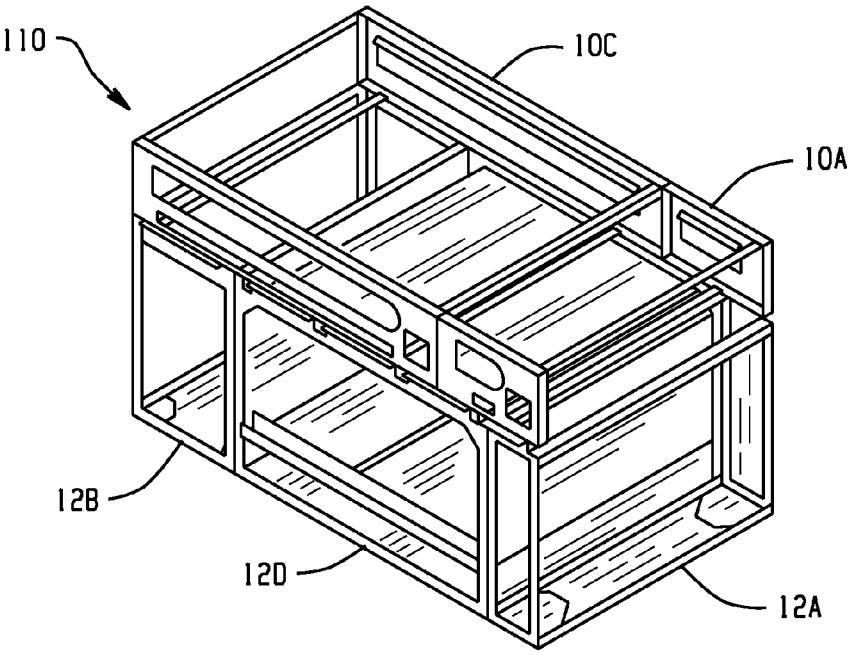
FIG. 11 shows a frame assembled view of another range unit configuration.

FIGS. 9 and 10 illustrated a range unit configuration 108 having the same width as range unit 106, but with a different cooktop configuration formed by top frame units 10A and 10C. This configuration would typically only be used where the two different width top frame units are preassembled with respective, different type cooking systems. The range unit configuration 110 in FIG. 11 uses the same frame units as range unit configuration 106 (FIGS. 9 and 10), but reverses the position of the top frame units 10A and 10C.

Figure 12:
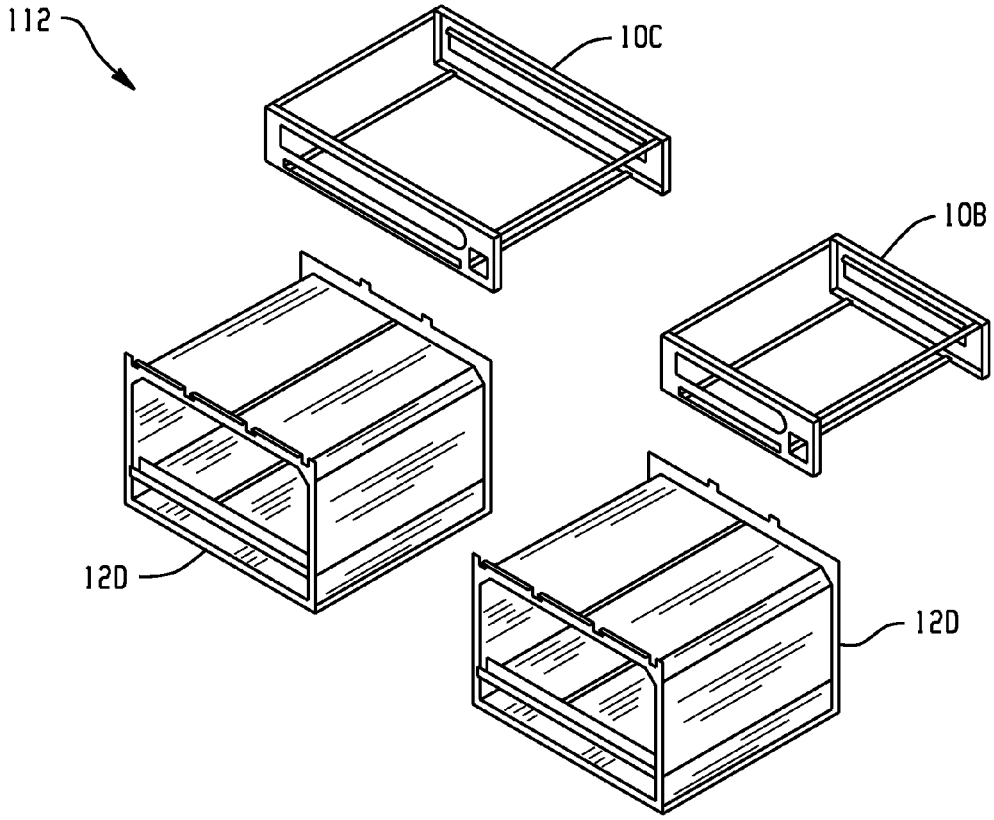
FIGS. 12 and 13 show frame exploded and frame assembled views of another range unit configuration.
Figure 13:
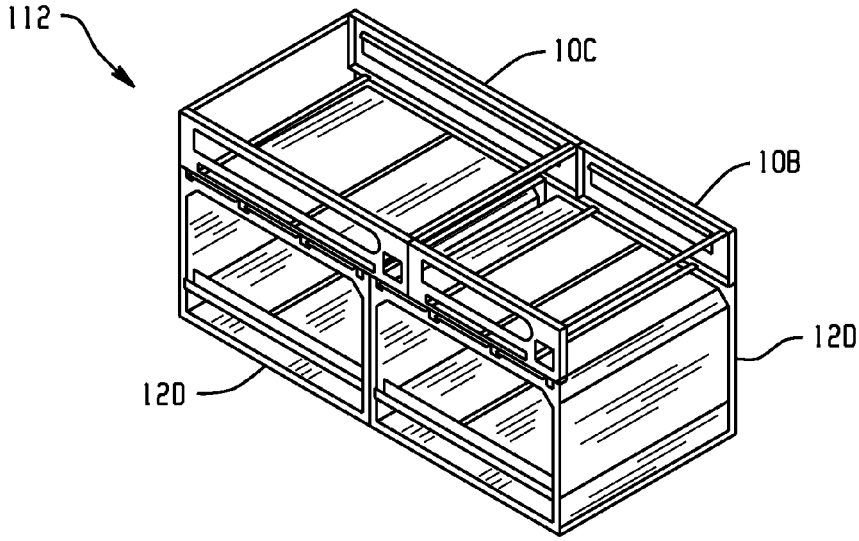
Figure 14:
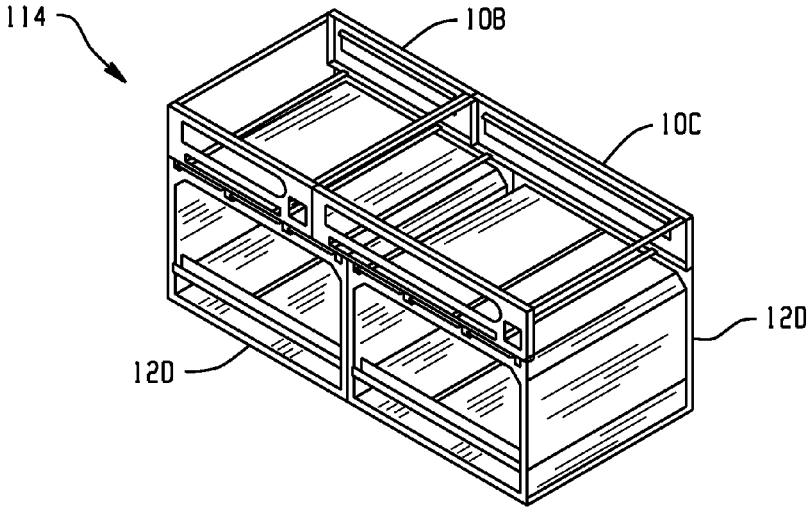
FIG. 14 shows a frame assembled view of another range unit configuration.

FIGS. 12 and 13 illustrate a range unit configuration 112, in which the top frame assembly is formed by top frame units 10B and 10C and the base frame assembly is formed by two joined base frame units 12D. The two top frame units 10B and 10C could be preassembled with the same type cooking system or with respective different type cooking systems as needed. In one implementation range unit 106 is a 60" wide range unit. The range unit configuration 114 in FIG. 14 uses the same frame units as range unit configuration 112 (FIGS. 12 and 13), but reverses the position of the top frame units 10B and 10C.

Figure 15:
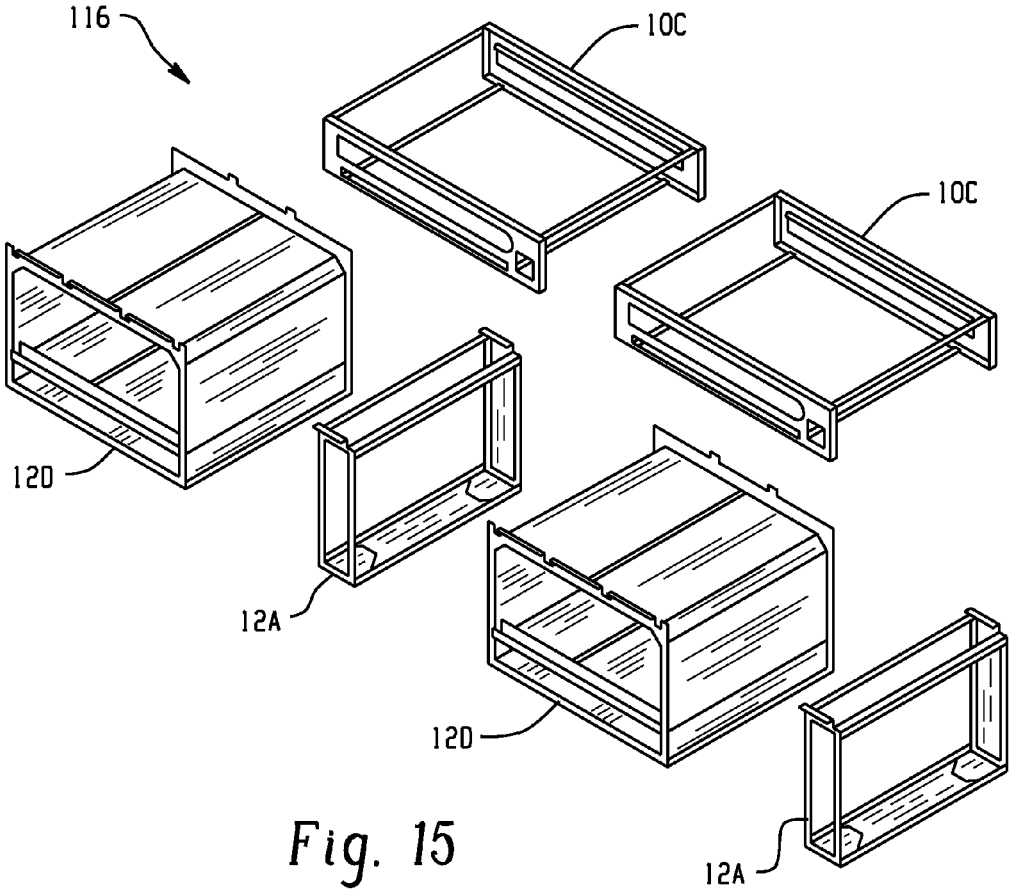
FIGS. 15 and 16 show frame exploded and frame assembled views of another range unit configuration.
Figure 16:
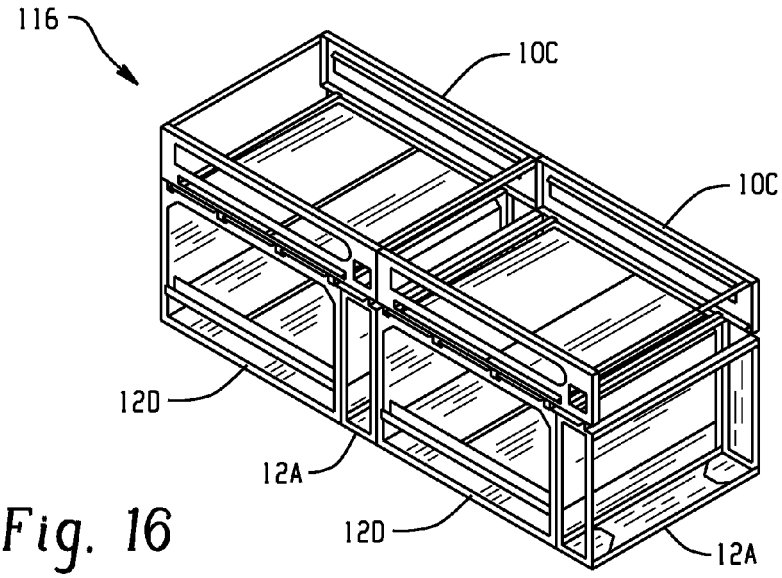

Referring to FIGS. 15 and 16, a range unit configuration 116 is shown, which includes a top frame assembly formed by two top frame units 10C and a base frame assembly formed by two base frame units 12D and two base frame units 12A. The two top frame units 10C could be preassembled with the same type cooking system or with respective different type cooking systems as needed. In one implementation range unit 116 is a 72" wide unit.

Figure 17:
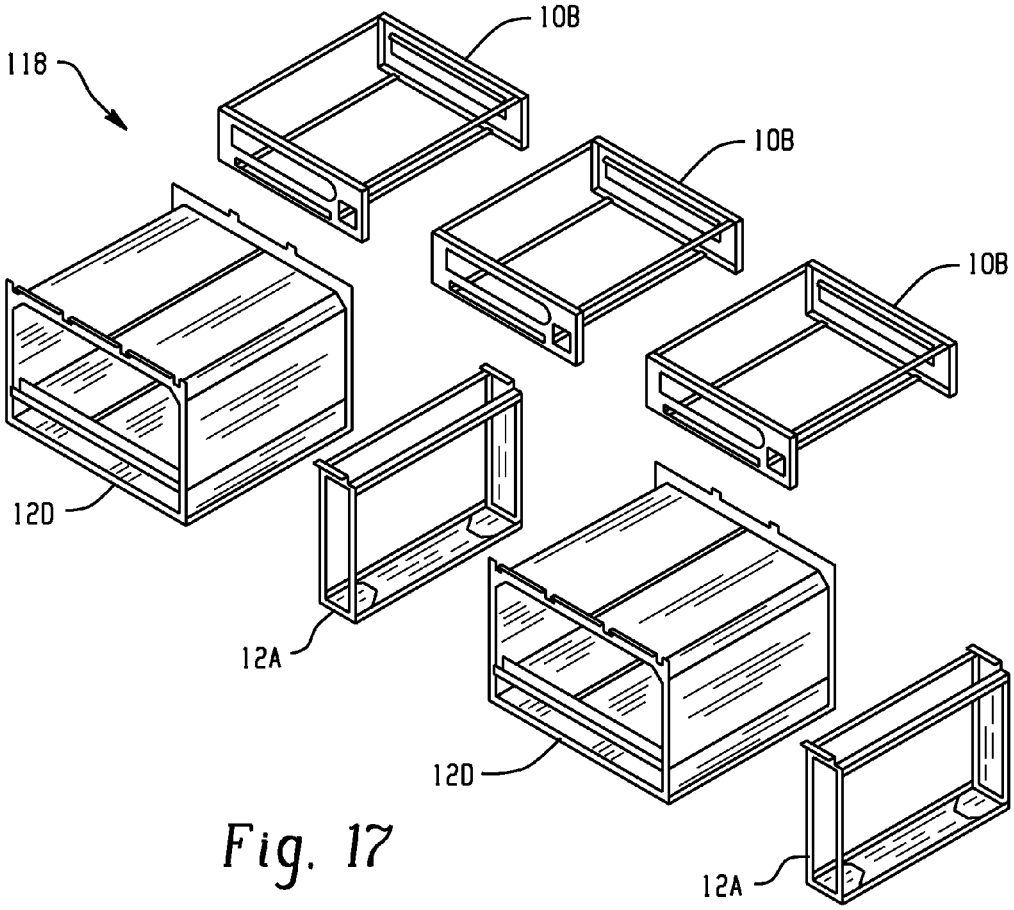
FIGS. 17 and 18 show frame exploded and frame assembled views of another range unit configuration.
Figure 18:
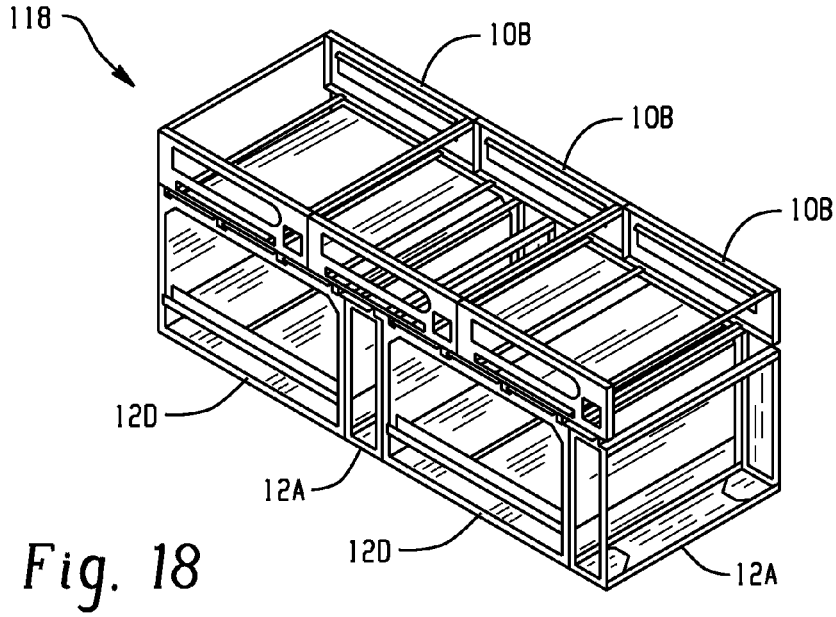

FIGS. 17 and 18 illustrate a range unit configuration 118 having the same width as unit 116, but different cooktop configuration formed by a top frame assembly with three top frame units 10B. Typically, at least one of the top frame units 10B would be preassembled with cooking system type that is different than the cooking system type preassembled into the other two top frame units 108.

Figure 19:
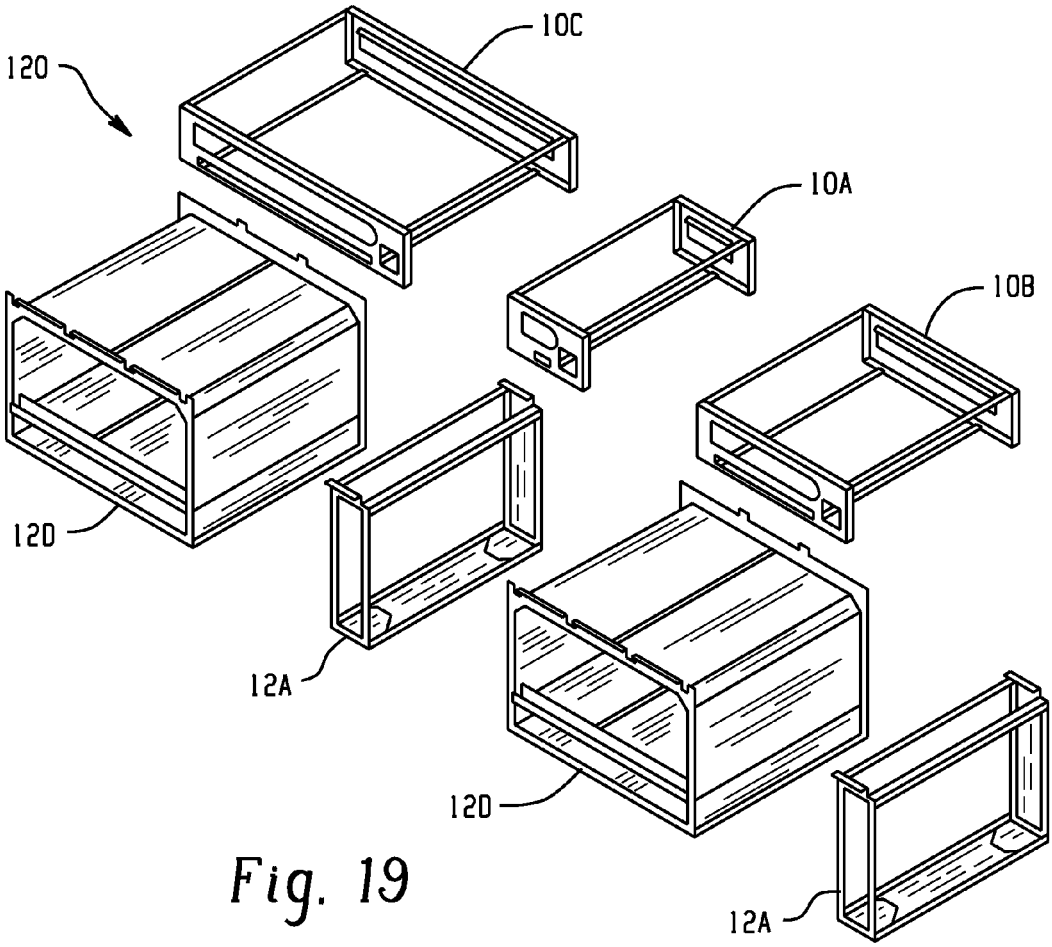
FIGS. 19 and 20 show frame exploded and frame assembled views of another range unit configuration.
Figure 20:
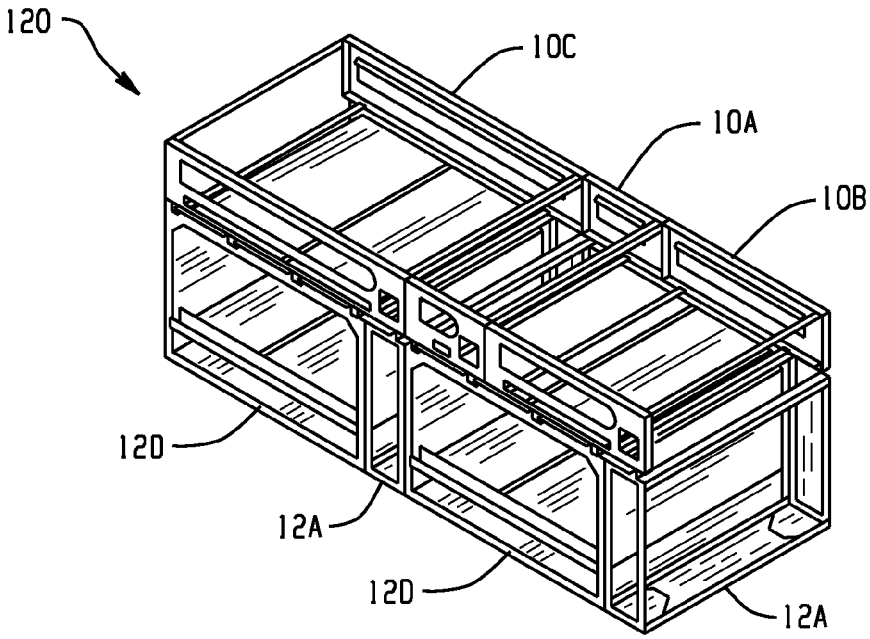
Figure 21:
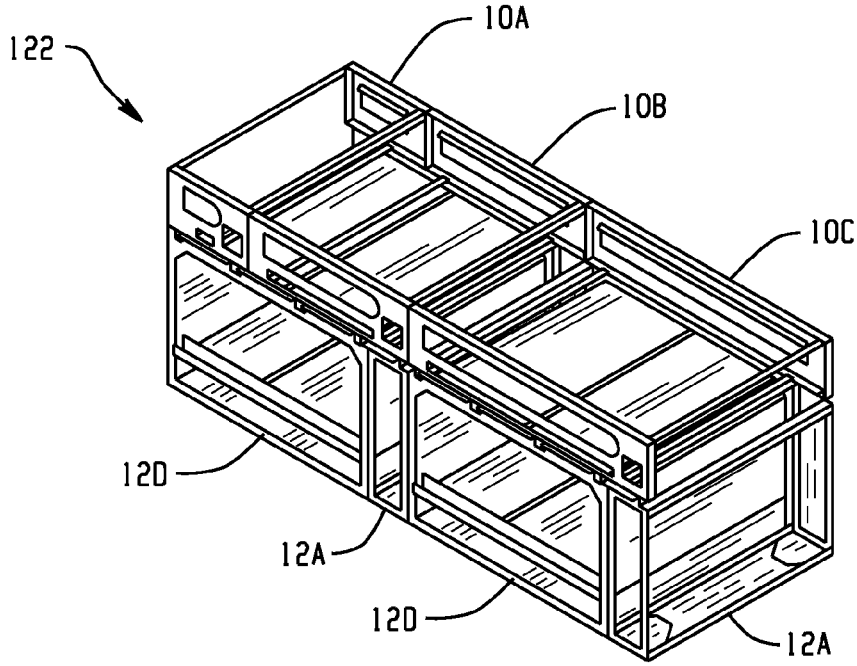
FIG. 21 shows a frame assembled view of another range unit configuration.

FIGS. 19 and 20 illustrate a range unit configuration 120 in which the top frame assembly is formed by top frame units 10A, 10B and 10C, and the base frame assembly is formed by two base frame units 12A and tow base frame units 12D. Range unit 120 has the same width as range units 116 and 118. Typically, the top frame units would be preassembled with three different, respective cooking system types. FIG. 21 illustrates a range unit configuration 122 made up of the same frame units as range unit 120, but with the order of the top frame units 10A, 10B and 10C rearranged.

Figure 22:
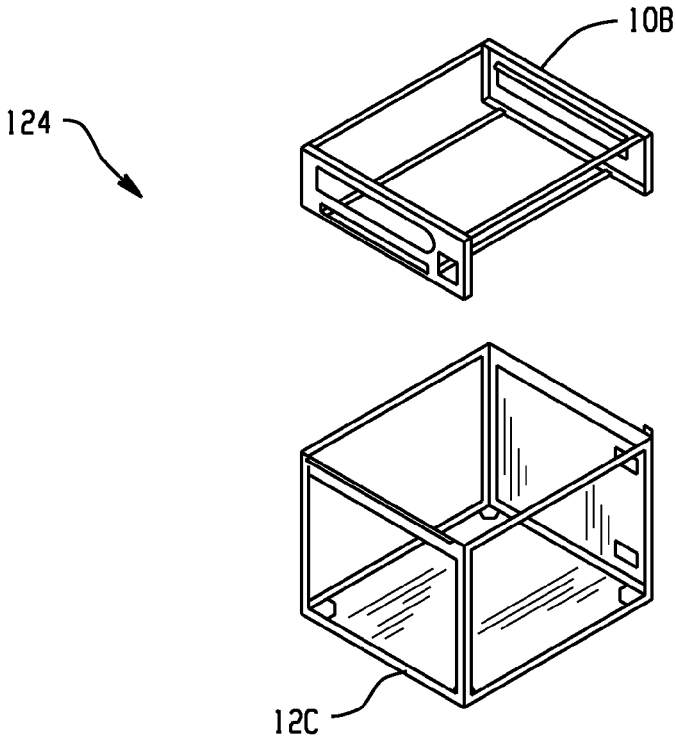
FIGS. 22 and 23 show frame exploded and frame assembled views of another range unit configuration.
Figure 23:
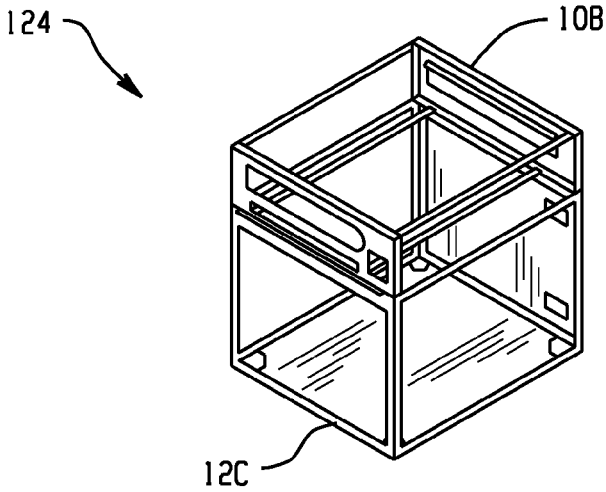

FIGS. 22 and 23 illustrate a range unit configuration 124 formed by placement of top frame unit 10B atop base frame unit 12C.

Figure 24:
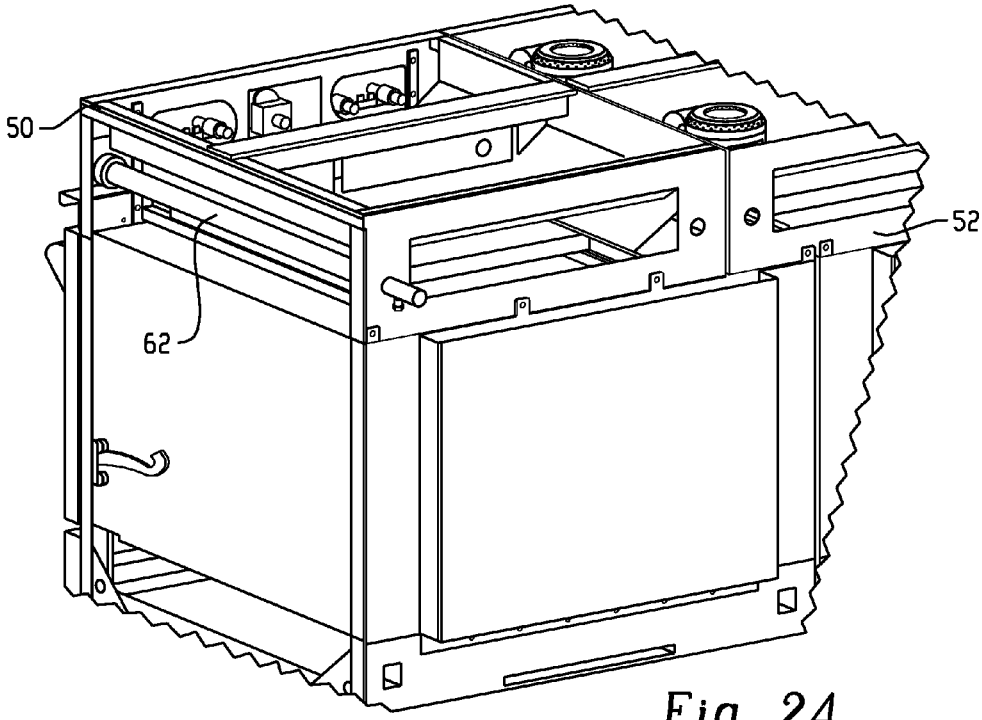
FIGS. 24 and 25 show partial perspectives of a range unit with gas manifold system.
Figure 25:
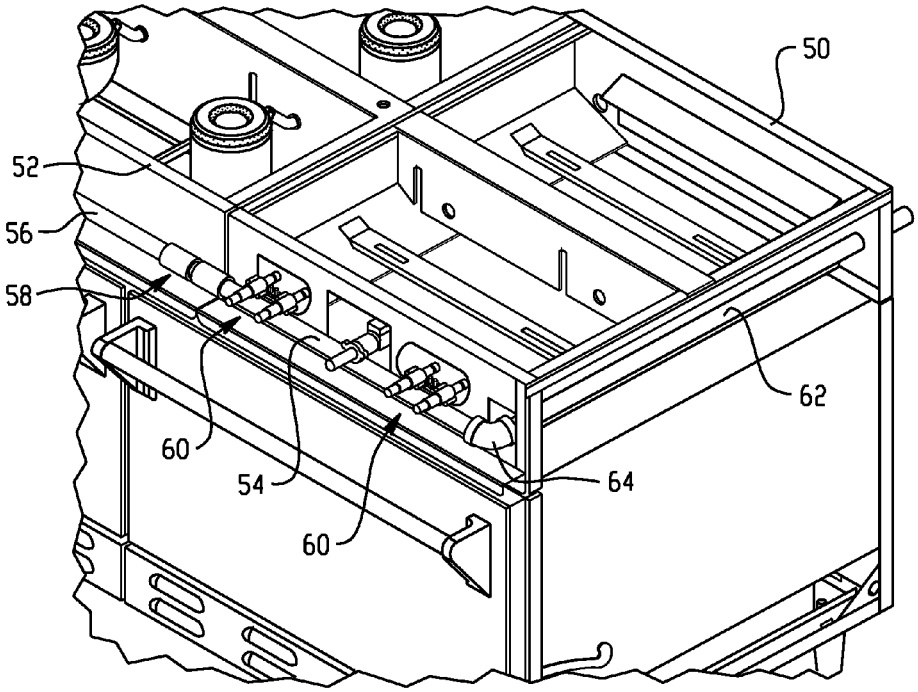
Figure 26:
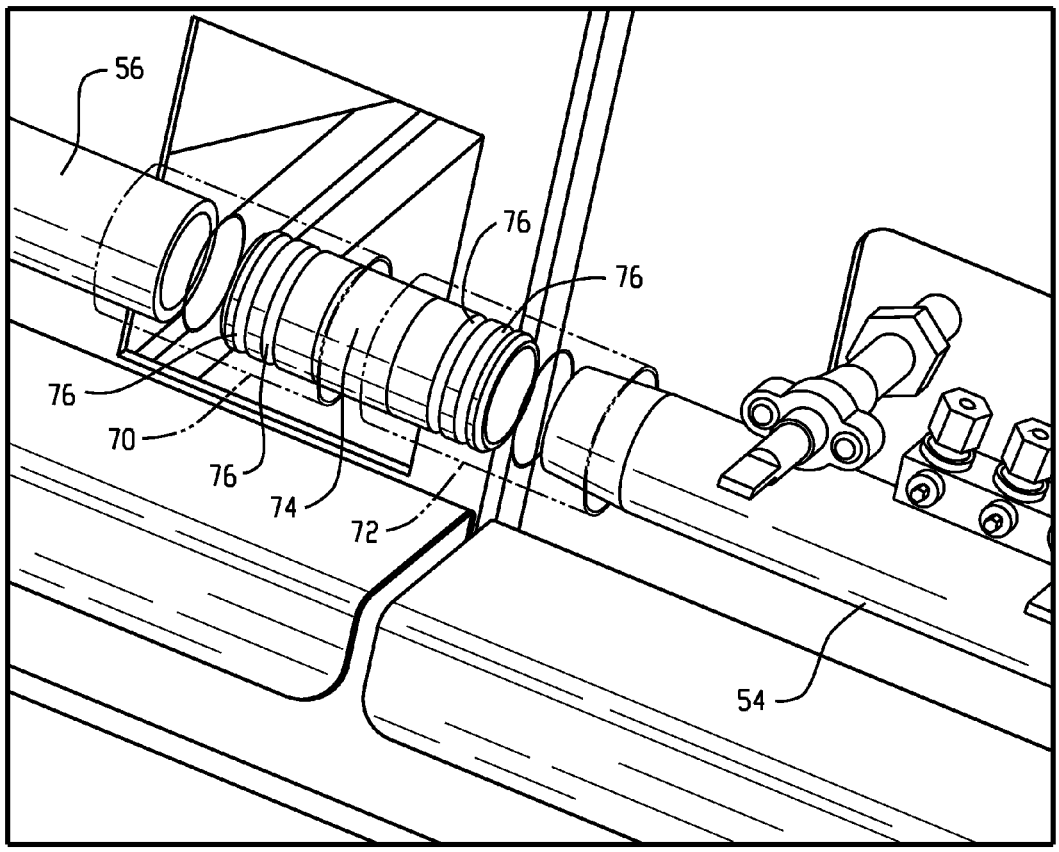
FIG. 26 shows an enlarged partial perspective of one embodiment of a coupler assembly for a range gas manifold system.

FIGS. 24 and 25 show rear and front perspectives of part of a range unit, with gas flow tubing illustrated. As shown in FIG. 25, top frame units 50 and 52 include a respective cooking system type and a respective laterally extending gas manifold 54 and 56 thereon. In the illustrated embodiment, each gas manifold is mounted on a front side of the frame, but the manifolds could also be mounted at the rear side of the frame. Suitable mounting brackets for the manifolds may be used. The gas manifolds 54 and 56 are preferably preassembled on each frame unit, and then coupled together (e.g., via a coupling assembly 58) upon mounting of the frame units on the base frame assembly to form a common, laterally extending gas manifold for the overall range unit. In this regard, if there are more than two top frame units used in forming the range, the gas manifold of all of the top frame units may be similarly coupled together to form the common, laterally extending gas manifold for the overall range unit. As illustrated, various control valves 60 may be associated with the gas manifold of each top frame unit, and may likewise form part of the preassembled components incorporated into each top frame unit. Typically, the gas manifold of one of the end top frame units will be selected for connection to a rearwardly extending gas feed pipe that, upon installation of the range unit, will be used to feed the common, laterally extending gas manifold of the range unit.

In one implementation, the gas manifold that is preassembled onto each top frame unit includes opposite ends, both of which are right hand threaded. The rear feed tube 62 is coupled to one end of the manifold via an elbow connector 64. The coupling assembly 58 may be any suitable components. However, in a preferred arrangement the coupling assembly 58 is formed by a pair of female couplers 70 and 72, each of which has one end internally threaded for connection to one end of the gas manifolds 56 and 54. The opposite end of each coupler has an internal end that is unthreaded for slidingly receiving one end of male coupler 74. Each end of the male coupler 74 includes a pair of spaced apart seats 76, each of which receives a sealing member such as an o-ring or other type gasket. This type of coupler assembly facilitates coupling and decoupling of top frame assemblies in the manufacturing/assembly facility and/or in the field, by simply moving one top frame unit laterally away from the other top frame unit. Facilitating this process in the fields makes range units field adaptable for reconfiguration by either (i) varying the side-by-side position of the existing top frame units of a range or (ii) removing one or more of the top frame units of a range and replacing them with new top frame modules.

It is recognized that in assembling the various frame units of a given range, fasteners may be used to hold the frame units together. Accordingly, the lateral sides of each top frame unit may be formed with openings at predetermined locations that are placed to align with the similar openings of another top frame unit that may be placed adjacent to it during assembly. Similarly, the upper frame pieces of each base frame unit and the lower frame pieces of each top frame unit may be formed with openings that will align to facilitate fastener securing.

Figure 27:
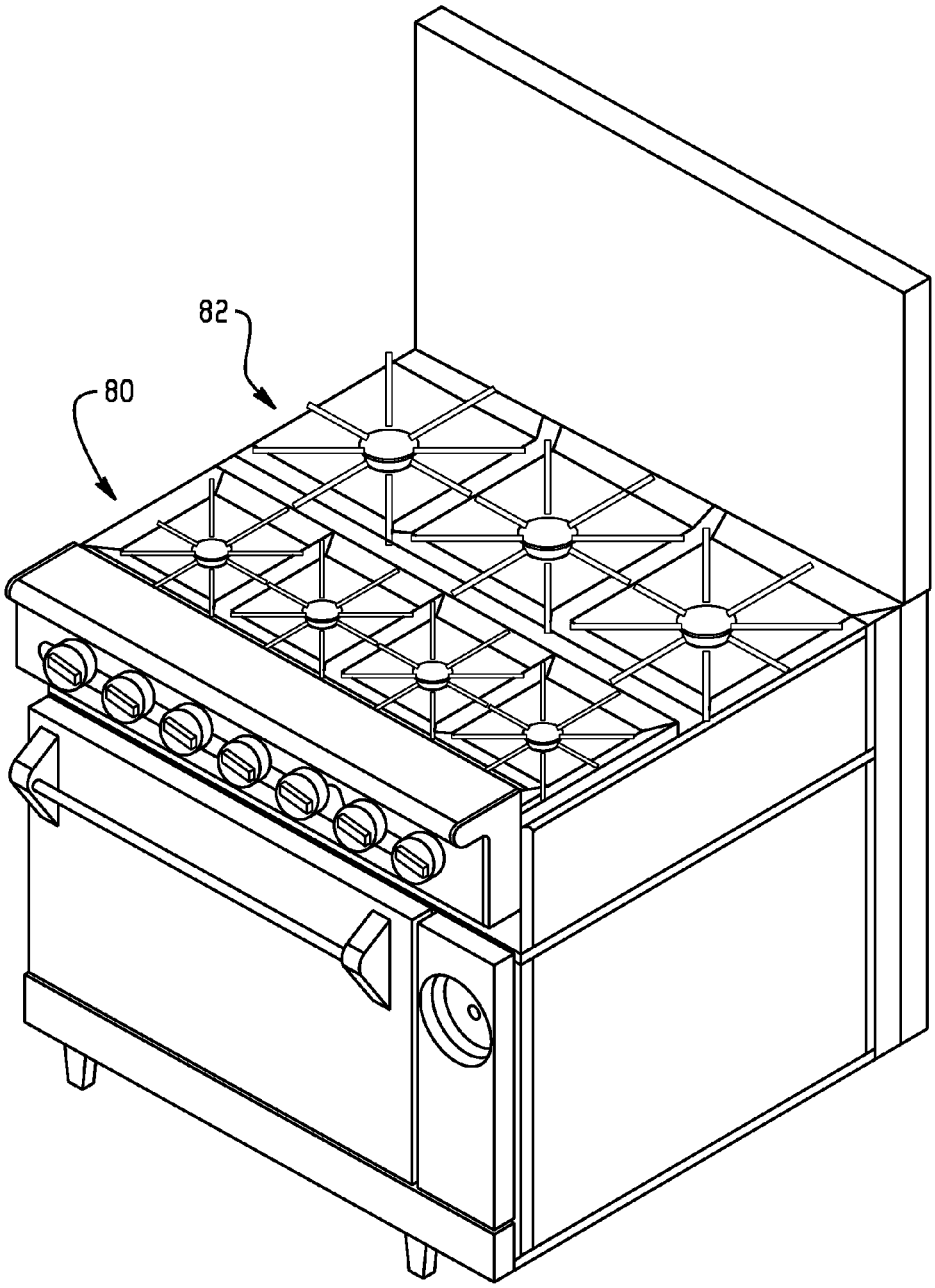
FIG. 27 shows a perspective view of one embodiment of a range with a space saver arrangement for open top burners.

With respect to cooking system types, the typical open top gas burner arrangement provided in a range provides either 11 or 12 inch wide grates over each of the side-by-side burners, where the burners are spaced apart 11 or 12 inches from center to center. In a typical 36" wide range this configuration limits the 36" range to 3 side-by-side burners in front and 3 side-by-side burners in back. As illustrated in FIG. 27, by providing 9" wide grates in the front row 80 of a range, with burners spaced apart 9 inches from center to center, four front burner positions are achieved, along with the three larger, back burner positions in the rear burner row 82. This configuration may be advantageous in certain kitchens where 8" saute pans are the most commonly utilized cooking vessel, thus not requiring the 11 or 12" wide burner positions. The 9" wide front burner positions could also be incorporated into other sizes, including 48", 60" and 72" wide units.

In another implementation of a modular range system, specific range assembly modules may be substantially preassembled and adapted for either in the field (e.g., at a customer site or a product distributor site) completion as a standalone unit or in the field combination with other range assembly modules to make a larger range assembly. A number of range completion kits may be provided (e.g., to distributors and other installers) for use in such in the field completion. By way of example, three range assembly module sizes may be used, namely 12" width, 24" width and 36" width. The substantially pre-assembled modules may then be completed (individually or in combination) in the field to provide available range width sizes of 12", 24", 36", 48" (e.g., combination of two 24" modules or a 12" module and 36" module), 60" (e.g., combination of 24" module and 36" module) and 72" (e.g., combination of two 36"modules).

By way of example, substantially pre-assembled modules may be provided as follows indicated in Table 1 below, where the term OTB means open-top burner, Mgrd means manually controlled griddle, Tgrd means thermostatically controlled griddle and Grid/Broil means griddle/broiler combination top.

TABLE 1

| Stocked Modules | | | |
|---|---|---|---|
| 12" Cabinet Base Module | 24" Cabinet Base Module | 36" Standard Oven Module | 36" Convection Oven Module |
| 2 OTB | 4 OTB | 6 OTB<br>4 OTB, 12" Mgrd<br>2 OTB, 24" Mgrd<br>36" Mgrd<br>2 OTB, 24" Grid/Broil<br>2 OTB, 24" Tgrd<br>36" Tgrd | 6 OTB<br>4 OTB, 12" Mgrd<br>2 OTB, 24" Mgrd<br>36" Mgrd<br>2 OTB, 24" Grid/Broil<br>2 OTB, 24" Tgrd<br>36" Tgrd |

As reflected above, in one implementation there a single 12" module configuration is provided (with 2 open-top burners), a single 24" module configuration is provided (with 4 open-top burners), multiple 36" standard oven modules are provided with varying top configurations and multiple 36" convection oven modules are provided with varying top configurations.

Also by way of example, the components are stocked to provide range completion kits to be used with the modules. The completion kits used to complete individual modules or combine individual modules are represented in Table 2 below.

TABLE 2

| Stocked Completion Kits | | | | | |
|---|---|---|---|---|---|
| 12" Kit | 24" Kit | 36" Kit | 48" Kit | 60" Kit | 72" Kit |
| 12" Wide Front Ledge<br>12" Wide Rear Riser<br>Hardware | 24" Wide Front Ledge<br>24" Wide Rear Riser<br>24" Wide Shelf<br>Hardware | 36" Wide Front Ledge<br>36" Wide Rear Riser<br>36" Wide Shelf<br>Hardware | 48" Wide Front Ledge<br>48" Wide Rear Riser<br>48" Wide Shelf<br>Gas Connect Piping<br>Hardware | 60" Wide Front Ledge<br>60" Wide Rear Riser<br>60" Wide Shelf<br>Gas Connect Piping<br>Hardware | 72" Wide Front Ledge<br>72" Wide Rear Riser<br>72" Wide Shelf<br>Gas Connect Piping<br>Hardware |

With reference to the above tables, a substantially pre-assembled 12" module (which by way of example could be assembled using frame elements 10A and 12B per FIG. 10 above) can be completed in the field using the components in 12" kit, a substantially pre-assembled 24" module (which by way of example could be assembled using frame elements 10B and 12C according to any of FIG. 23 above) can be completed in the field using the components in the 24" kit and a substantially pre-assembled 36" module (which by way of example could be assembled using frame elements according to any of FIGS. 3, 5 and 6 above) can be completed in the field using the components in the 36" kit. Moreover, a 48"range assembly can be completed in the field by combining a substantially pre-assembled 12" module (which by way of example could be assembled using frame elements 10A and 12B per FIG. 10 above) and substantially pre-assembled 36" module (which by way of example could be assembled using frame elements according to any of FIGS. 3, 5 and 6 above) using the components of the 48" kit, a 60"range assembly can be completed in the field by combining a substantially pre-assembled 24" module (which by way of example could be assembled using frame elements 10B and 12C according to any of FIG. 23 above) and substantially pre-assembled 36" module (which by way of example could be assembled using frame elements according to any of FIGS. 3, 5 and 6 above) using the components of the 60" kit and a 72"range assembly can be completed in the field by combining a first substantially pre-assembled 36" module (which by way of example could be assembled using frame elements according to any of FIGS. 3, 5 and 6 above) and a second substantially pre-assembled 36" module (which by way of example could be assembled using frame elements according to any of FIGS. 3, 5 and 6 above) using the components of the 72" kit.

Figure 28:
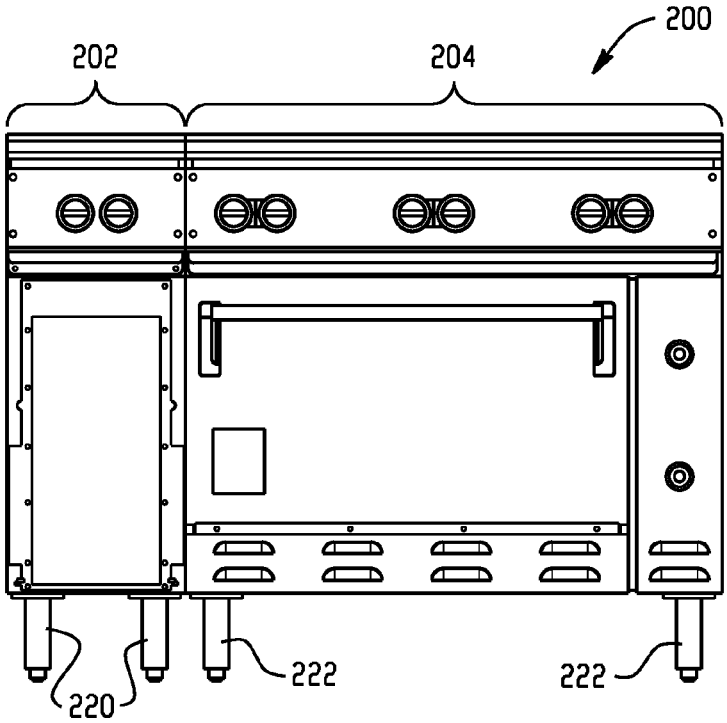
FIGS. 28-30 depict one embodiment of a 48" range configuration.
Figure 29:
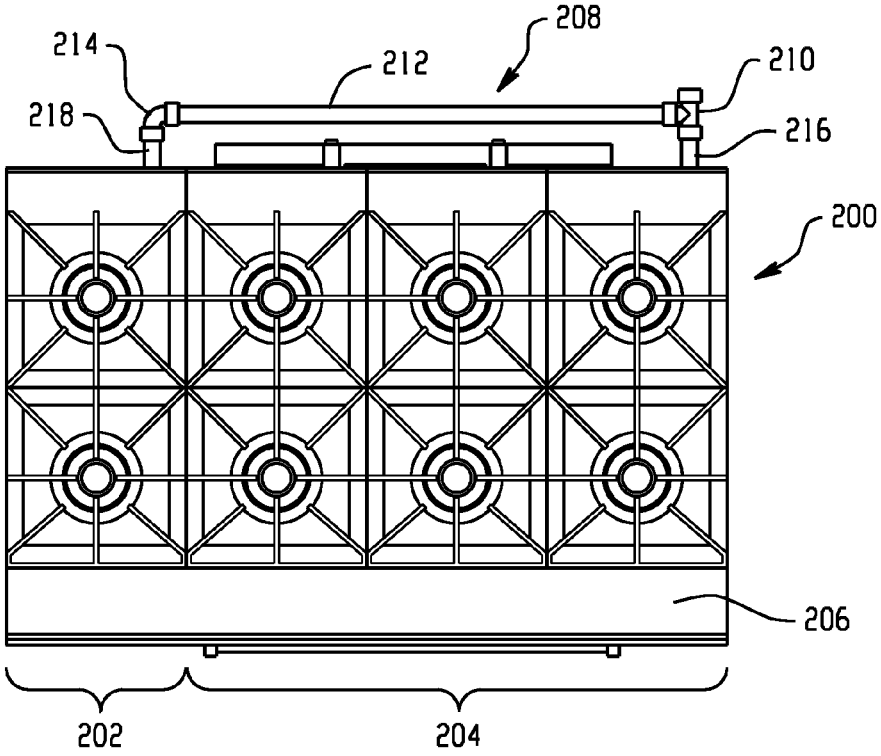
Figure 30:
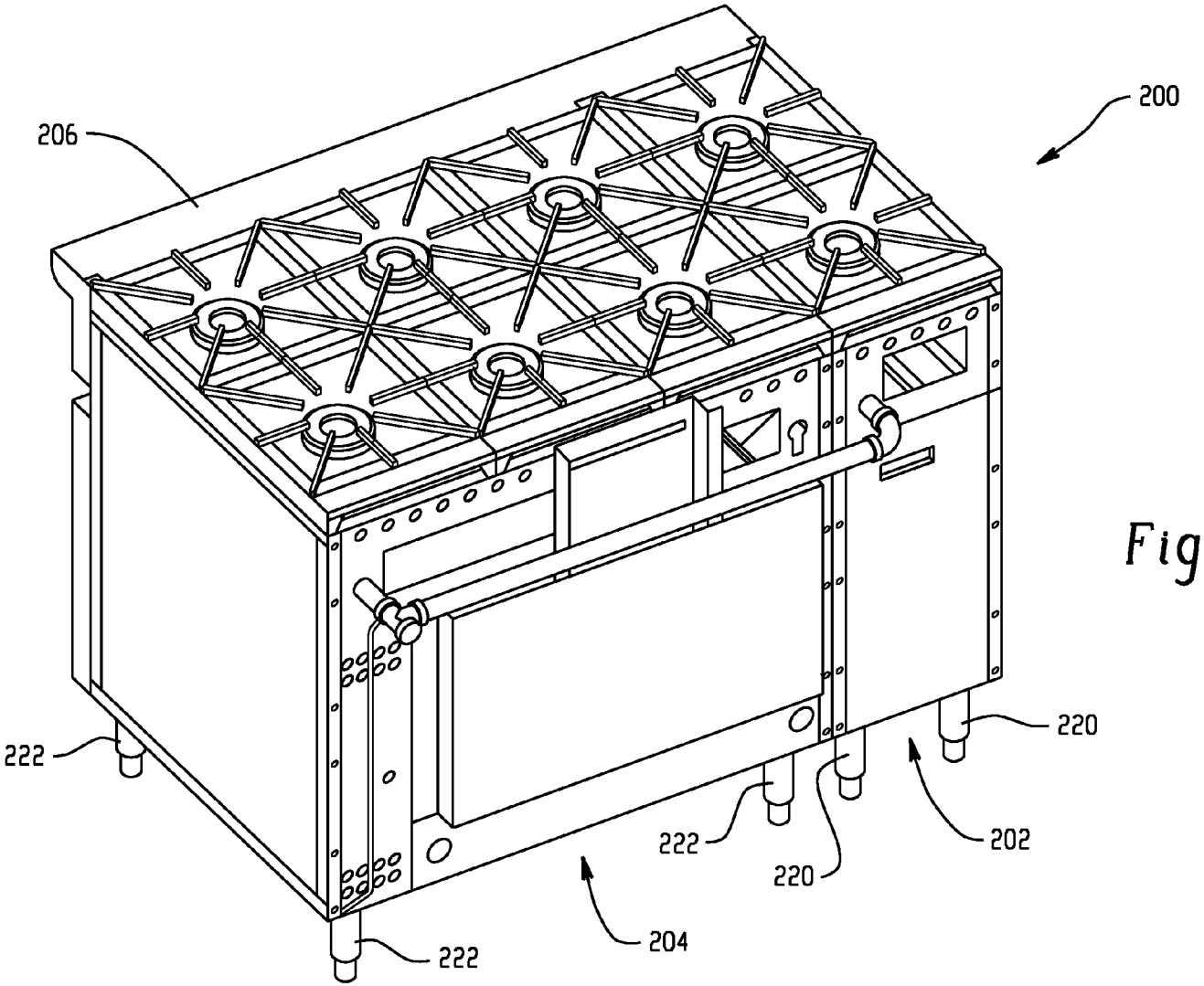

Referring now to FIGS. 28-30, front elevation, top plan and rear perspective views are shown of a 48" finished range configuration 200 formed by combining two substantially pre-assembled modules utilizing the components of a 48" completion kit. Specifically a 12" 2 OTB module 202 and a 36" 6 OTB module 204 combined with a 48" front ledge 206 and 48" rear riser and shelf (not shown), as well as gas connection piping 208. The piping 208 includes a T-fitting 210, a cross-pipe 212 and a 90 degree elbow fitting 214, to assure that the gas inlet 216 and 218 of each module will receive gaseous fuel as needed. A shown, each module 202 and 204 a set of 4 legs, 220 and 222 respectively, which also may be installed in the field. As an alternative to the legs, casters may be provided.

Figure 31:
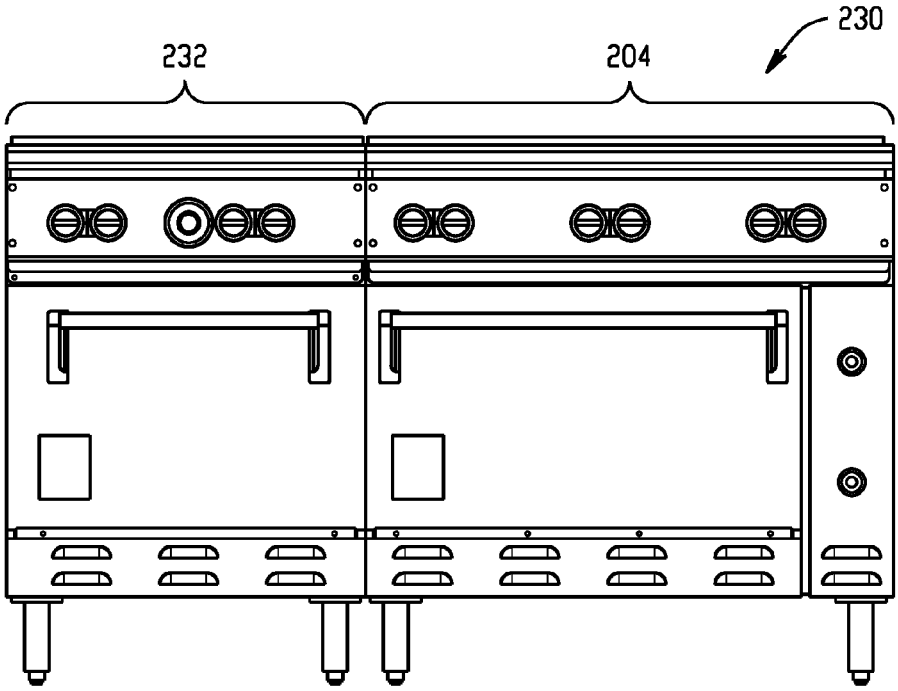
FIGS. 31-32 depict one embodiment of a 60" range configuration.
Figure 32:
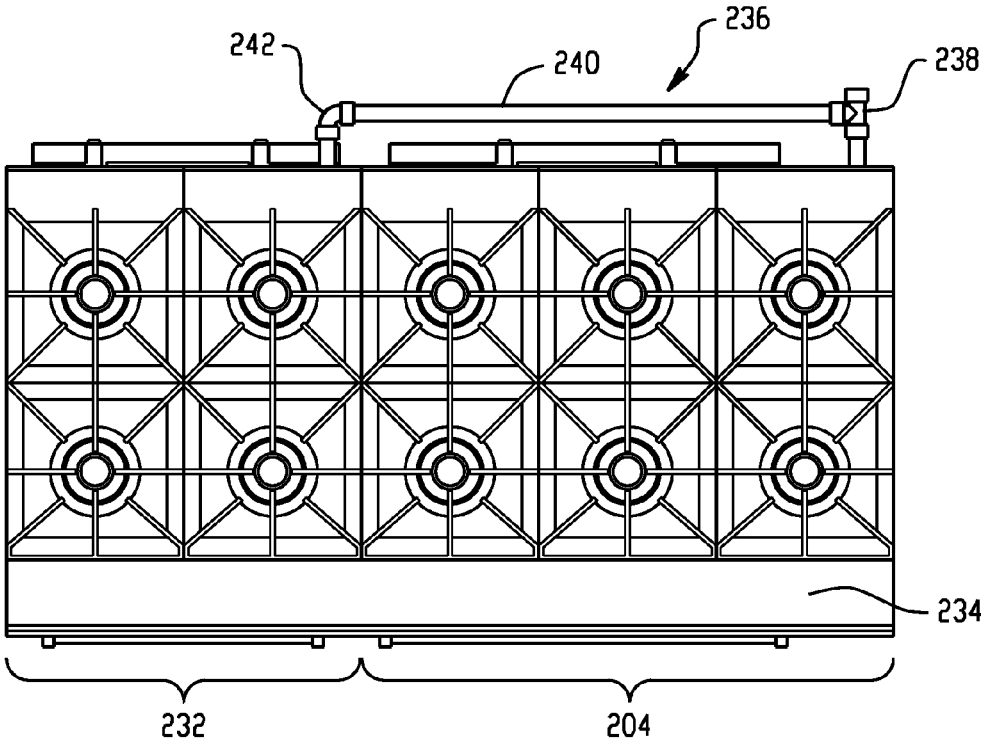

Referring now to FIGS. 31-32, front elevation and top plan views are shown of a 60" range configuration 230 formed by combining two substantially pre-assembled modules utilizing the components of a 60" completion kit. Specifically a 24" 4 OTB module 232 and a 36" 6 OTB module 204 combined with a 60" front ledge 234 and 60" rear riser and shelf (not shown), as well as gas connection piping 236, which includes the same components as used for range 200, namely a T-fitting 238, a cross-pipe 240 and a 90 degree elbow fitting 242.

Figure 33:
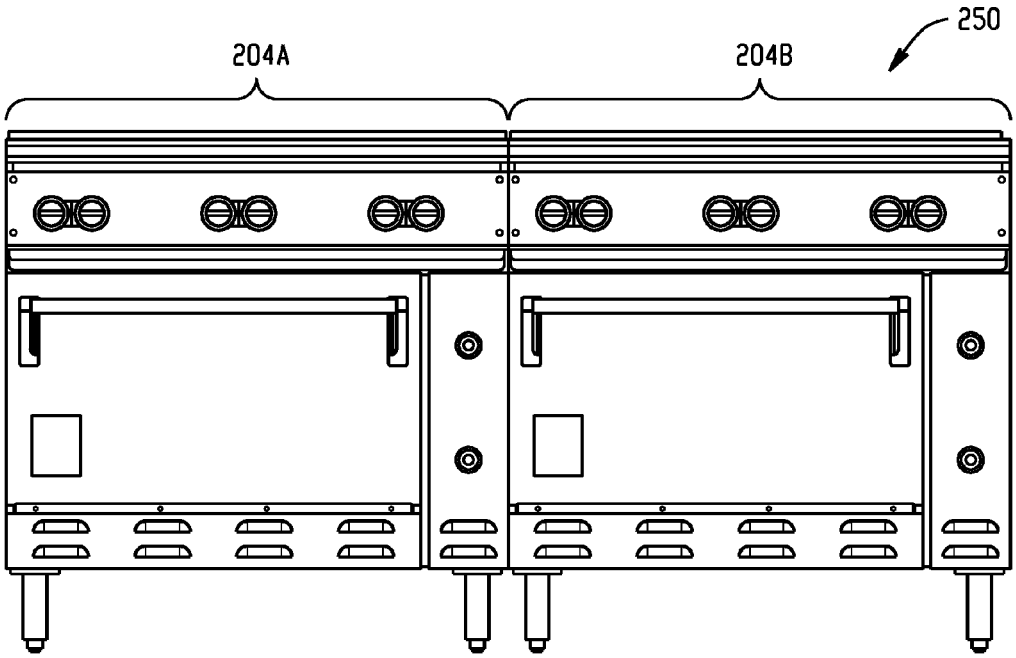
FIGS. 33-35 depict one embodiment of a 72" range configuration.
Figure 34:
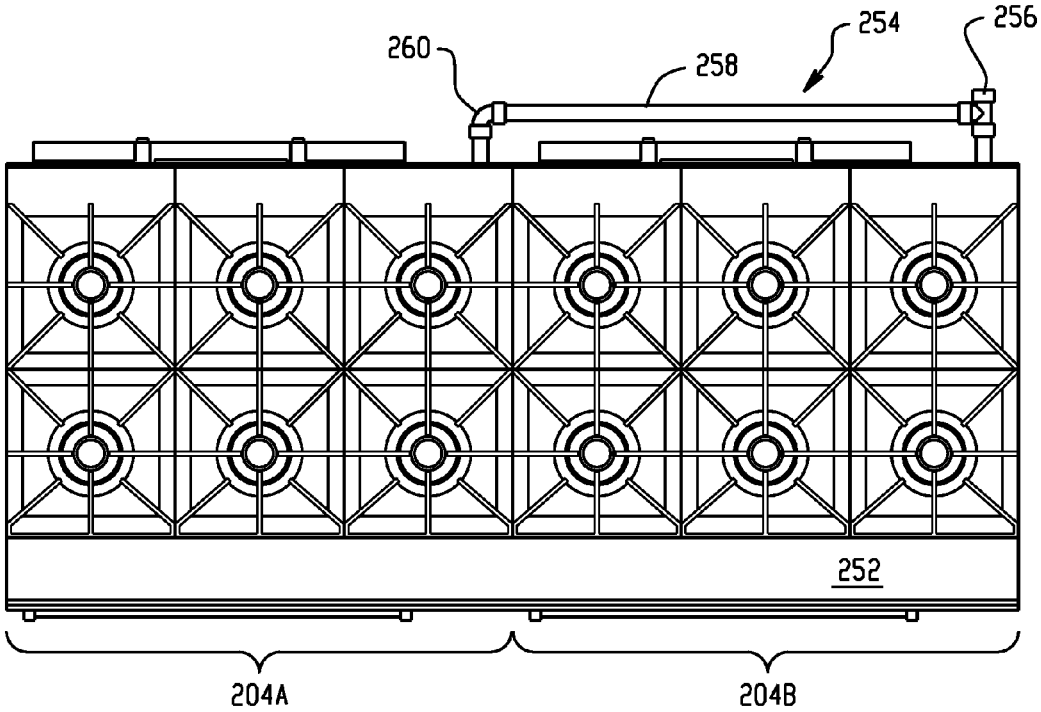
Figure 35:
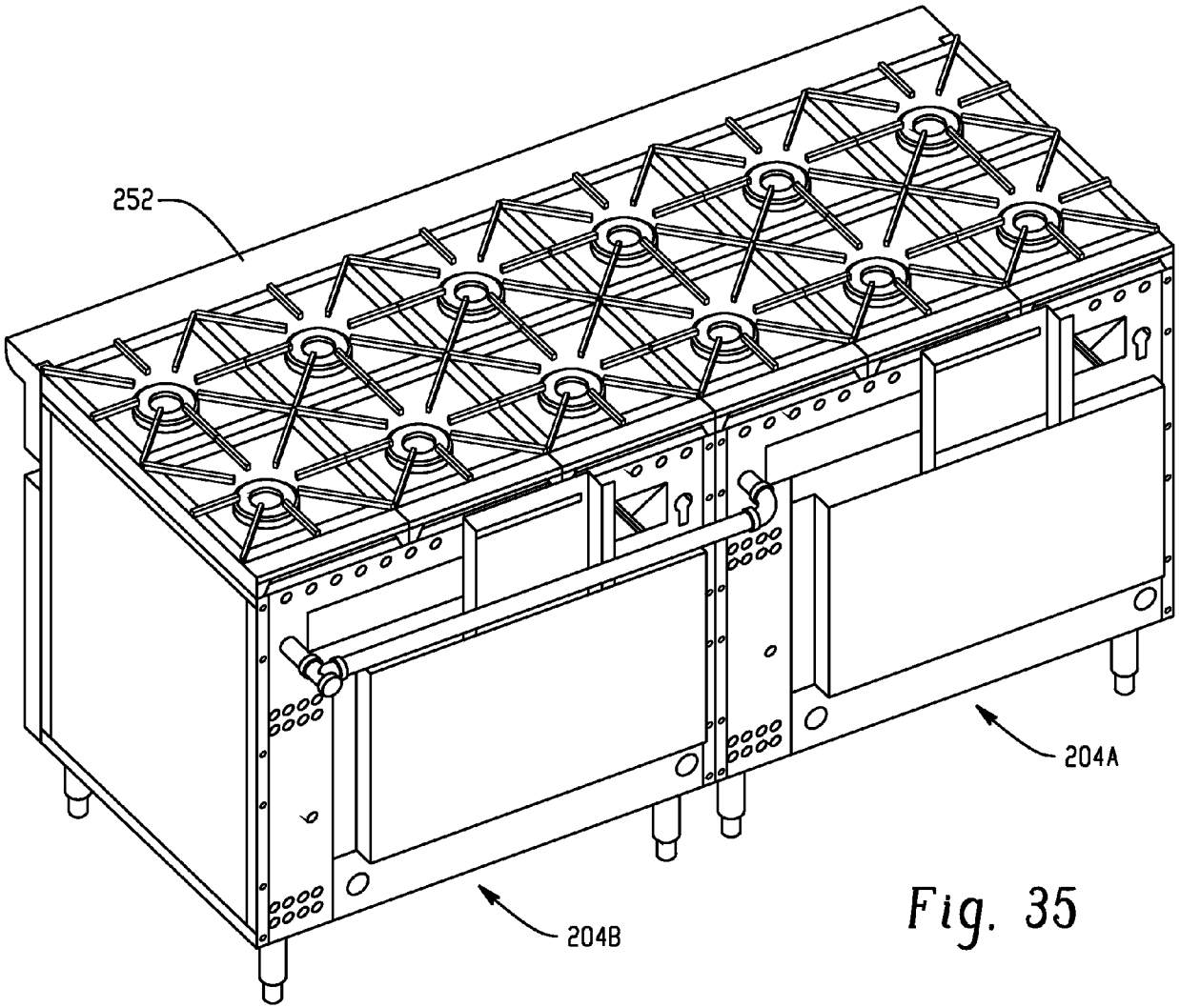

Referring now to FIGS. 33-35, front elevation, top plan and rear perspective views are shown of a 72" range configuration 250 formed by combining two substantially pre-assembled modules utilizing the components of a 72" completion kit. Specifically, a 36" 6 OTB module 204A and a 36" 6 OTB module 204B combined with a 72" front ledge 252 and 60" rear riser and shelf (not shown), as well as gas connection piping 254, which includes the same components as used for range 200, namely a T-fitting 256, a cross-pipe 258 and a 90 degree elbow fitting 260.

Figure 36:
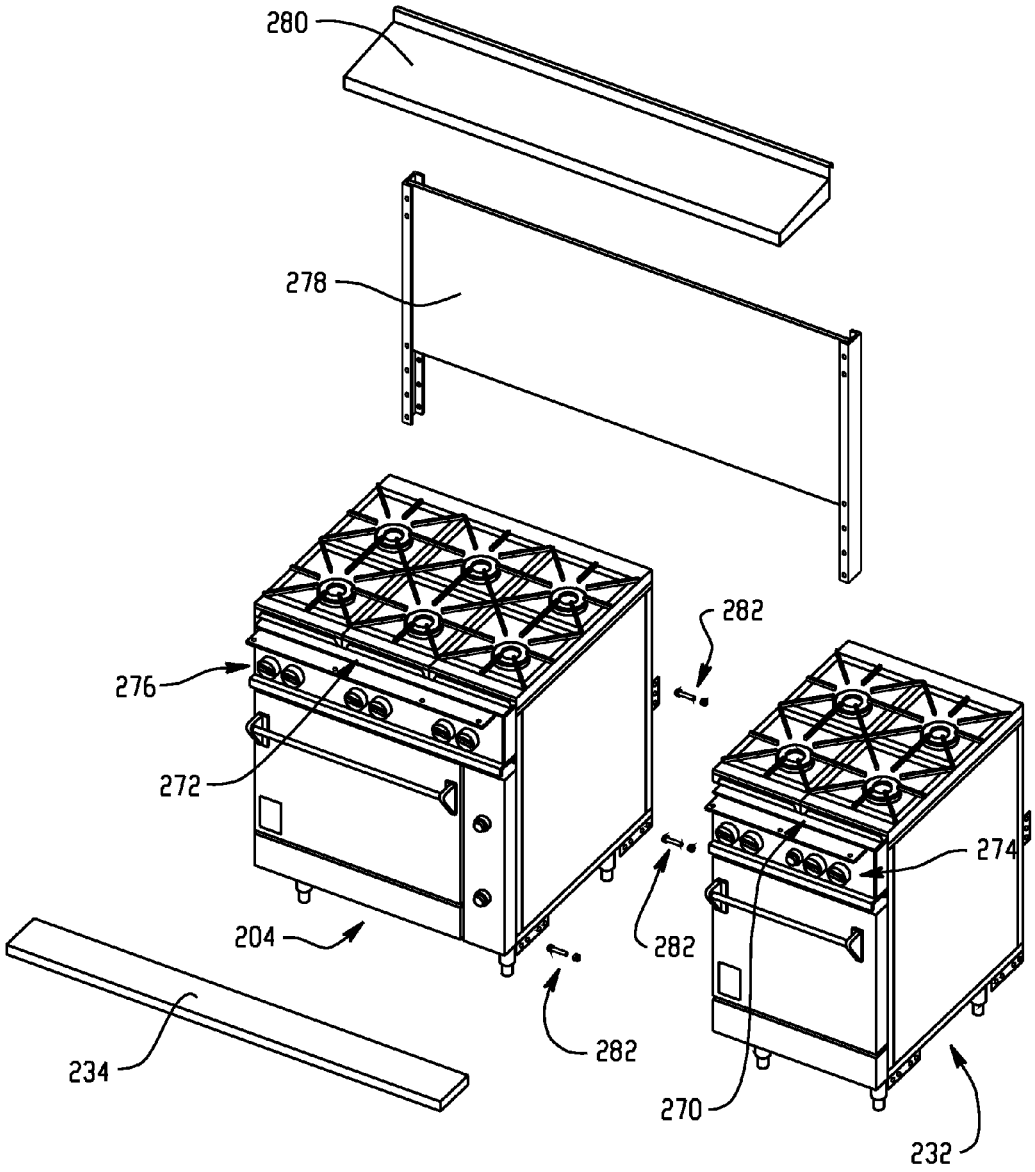
FIG. 36 shows an exploded view of portions of a 60" range configuration.

In the case of each substantially pre-assembled module, the modules are substantially complete but for certain components, namely the front ledge and the rear riser (and shelf if applicable. The modules are also formed with structure for readily interconnecting the modules side-by-side to former larger range assemblies when combined. In this regard, reference is made to FIGS. 36-39 to describe an exemplary assembly process for two modules using a kit. As shown in FIG. 36, a 24" module 232 and 36" module 204 are shown in substantially pre-assembled form and prior to interconnection to form a 60" range. Each module includes a respective open region 270, 272 above the module controls 274, 276. The larger components of a 60" combination kit are also shown, namely the 60" front ledge 234, the 60" rear riser 278 and the 60" shelf 280. The hardware for interconnecting the modules, namely nut and bolt assemblies 282 are also shown. Additional hardware for connecting the front ledge, rear riser and shelf is not shown.

Figure 37:
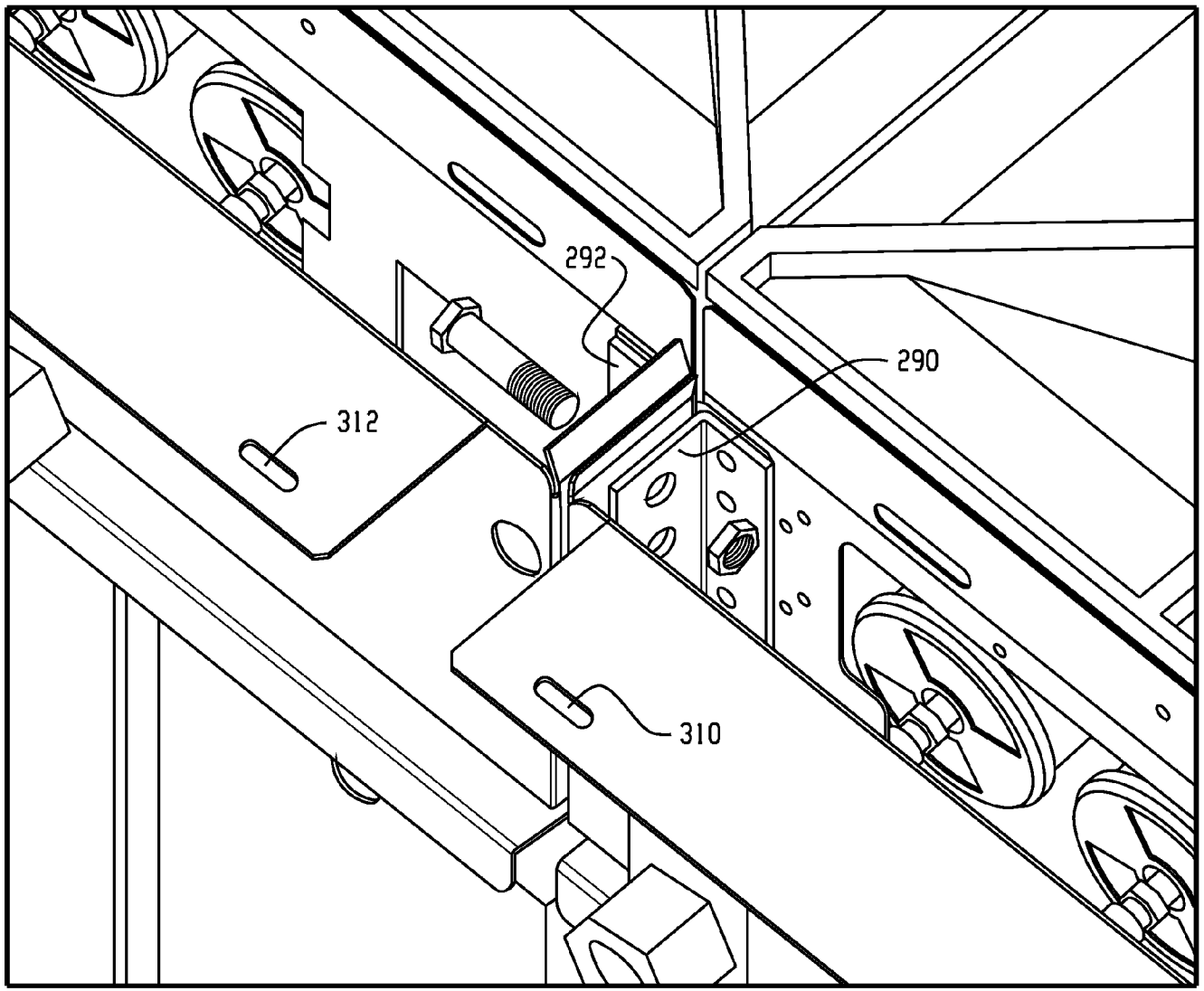
FIG. 37 shows a partial perspective of front top interconnecting structure for the 60" range configuration of FIG. 36.
Figure 38:
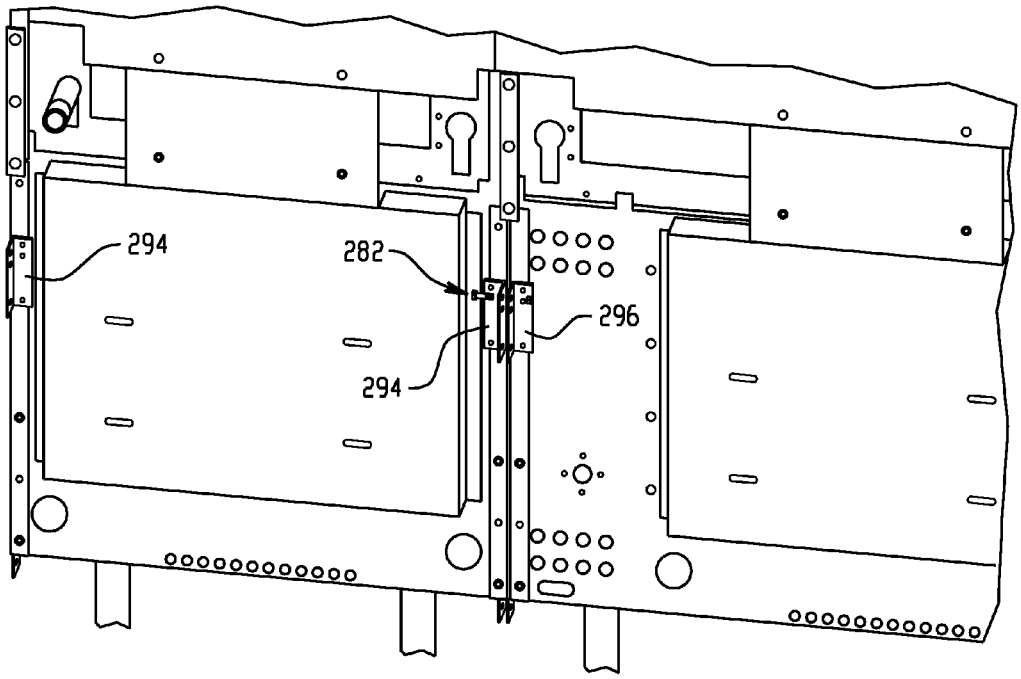
FIG. 38 shows a partial rear perspective of rear top interconnecting structure for the 60" range configuration of FIG. 36.
Figure 39:
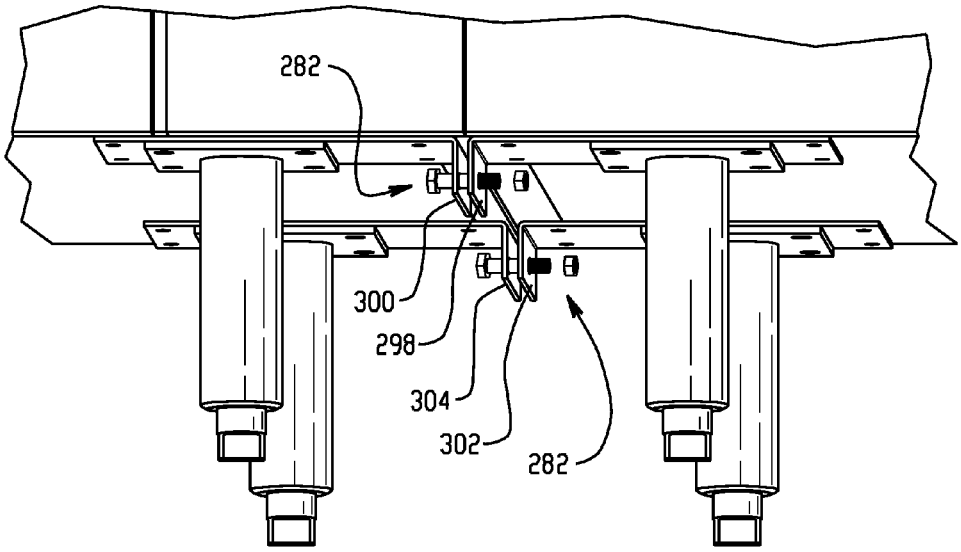
FIG. 39 shows a partial bottom rear perspective of lower interconnecting structure for the 60" range configuration of FIG. 36.

As best seen in FIGS. 37-39, the modules are each formed with left and right bracket components to enable interconnection of the modules, specifically front upper bracket components 290 and 292, rear upper bracket components 294 and 296, front lower bracket components 298 and 300 and front rear bracket components 302 and 304. When the modules 204 and 232 are abutted side-by-side against each other, and matched depthwise, openings in the brackets of each module align so that the nut and bolt assemblies can be used to rigidly connect the two modules together. In each case, the bracket components may be L-shaped members having one part secured to the frame of the module (e.g., by bolts or other fasteners) and the other part protruding outward. The rear riser 278 may similarly be connected to bracket components on the modules after the modules have been fixed together, or could alternatively be connected directly to the framing of the combined modules. The hardware in the kit would also include suitable fasteners for connecting the shelf 280 to the rear riser 278, as well as fasteners for connecting the front ledge 234 to the combined modules (e.g., using the slot openings 310 and 312 (FIG. 37) formed at the front of the pre-assembled modules. Installation of the gas distribution piping from the kit would also be completed after the modules have been combined, for produce a combined unit in which a single gaseous fuel inlet connection will feed gaseous fuel to the inlets of both modules.

Utilizing above-described module and kit system, numerous range configurations can be achieved in the field by stocking a relatively small number of modules along with the kit components. By way of example, and referring to Table 1, the 24" module could be combined with any one of the 14 different 36" module configurations to form 28 different 60" range configurations when you consider all configurations in which the 24" module is on the left side of the combination and all configurations in which the 24" module is on the right side of the combination. The methodology therefore provides for significant reduction in stocking requirements needed to quickly fill orders for a larger number of range configurations. Moreover, shipping and installation is better facilitated, as it is much simpler for a one or two person crew to move two 36" modules than one 72" module. Use of the kits provides for seemless top ledges and rear risers even when two modules are connected to form a wider, final range configuration.

It is to be clearly understood that the above description is intended by way of illustration and example only, is not intended to be taken by way of limitation, and that various changes and modifications are possible.

What is claimed is:

1. A method of manufacturing a range unit, the method comprising:

(a) stocking a first substantially pre-assembled range module having a first width and first top configuration;

(b) stocking a second substantially pre-assembled range module having a second width and second top configuration;

(c) to fill an order for a range having a third width and third top configuration, where the third width is equal to the sum of the first width and the second width and the third top configuration is a combination of the first top configuration and the second top configuration, performing the steps of:

(c-i) placing the first substantially pre-assembled range module adjacent the second substantially pre-assembled range module;

(c-ii) rigidly connecting the first substantially pre-assembled range module adjacent the second substantially pre-assembled range module using interconnecting structure located on the range modules to form a combined assembly;

(c-iii) connecting a front ledge having the third width to both mount structure at a front of the first substantially pre-assembled range model and mount structure at a front of the second substantially pre-assembled range module to provide a seamless front ledge across the combined assembly.

2. The method of claim 1 wherein step (c) further includes:

(c-iv) connecting a rear riser having the third width to the combined assembly to provide a seamless rear riser across the combined assembly.

3. The method of claim 1 wherein:

the first substantially pre-assembled range module includes a first gaseous fuel inlet;

the second substantially pre-assembled range module includes a second gaseous fuel inlet;

step (c) includes:

interconnecting the first gaseous fuel inlet and the second gaseous fuel inlet to provide the combined assembly with a single gaseous fuel inlet connection that feeds both gaseous fuel inlets.

4. The method of claim 1 wherein first substantially pre-assembled range module and second substantially pre-assembled range module are stocked by one of a range manufacturer or a range distributor.

5. The method of claim 1, wherein the combined assembly is a first combined assembly and the method further comprises:

(d) stocking a third substantially pre-assembled range module having the second width and a fourth top configuration;

(e) to fill an order for a range having the third width and a fifth top configuration, where the third width is equal to the sum of the first width and the second width and the fifth top configuration is a combination of the first top configuration and the fourth top configuration, performing the steps of:

(e-i) placing the first substantially pre-assembled range module adjacent the third substantially pre-assembled range module;

(e-ii) rigidly connecting the first substantially pre-assembled range module adjacent the third substantially pre-assembled range module using interconnecting structure located on the range modules to form a second combined assembly.

6. The method of claim 5 wherein:

step (c) includes:

(c-iv) connecting a rear riser having the third width to the first combined assembly to provide a seamless rear riser across the first combined assembly; step (e) includes:

(e-iii) connecting a front ledge having the third width to the second combined assembly to provide a seamless front ledge across the second combined assembly; and (e-iv) connecting a rear riser having the third width to the second combined assembly to provide a seamless rear riser across the second combined assembly.

7. A method of manufacturing a range unit, the method comprising:

(a) stocking a first substantially pre-assembled range module having a first width and first top configuration;

(b) stocking a second substantially pre-assembled range module having a second width and second top configuration;

(c) to fill an order for a range having a third width and third top configuration, where the third width is equal to the sum of the first width and the second width and the third top configuration is a combination of the first top configuration and the second top configuration, performing the steps of:

(c-i) placing the first substantially pre-assembled range module adjacent the second substantially pre-assembled range module;

(c-ii) rigidly connecting the first substantially pre-assembled range module adjacent the second substantially pre-assembled range module using interconnecting structure located on the range modules to form a combined assembly;

wherein the first substantially pre-assembled range module includes a plurality of brackets, the second substantially pre-assembled range module includes a plurality of brackets, brackets of the first substantially pre-assembled range module aligning with brackets of the second substantially pre-assembled range module to provide the interconnecting structure when a side of the first substantially pre-assembled range module directly abuts a side of the second substantially pre-assembled range module.

8. The method of claim 7 wherein nut and bolt assemblies are passed through aligned openings of aligned brackets to achieve the rigid connection.

9. A method of manufacturing a range unit, the method comprising:

(a) stocking a first substantially pre-assembled range module having a first width and first top configuration;

(b) stocking a second substantially pre-assembled range module having a second width and second top configuration;

(c) to fill an order for a range having a third width and third top configuration, where the third width is equal to the sum of the first width and the second width and the third top configuration is a combination of the first top configuration and the second top configuration, performing the steps of:

(c-i) placing the first substantially pre-assembled range module adjacent the second substantially pre-assembled range module;

(c-ii) rigidly connecting the first substantially pre-assembled range module adjacent the second substantially pre-assembled range module using interconnecting structure located on the range modules to form a combined assembly;

(c-iii) connecting a front ledge having the third width to the combined assembly to provide a seamless front ledge across the combined assembly;

(c-iv) connecting a rear riser having the third width to the combined assembly to provide a seamless rear riser across the combined assembly;

wherein the first substantially pre-assembled module includes a plurality of brackets, the second substantially pre-assembled module includes a plurality of brackets, brackets of the first substantially pre-assembled module aligning with brackets of the second substantially pre-assembled module to provide the interconnecting structure;

wherein:

the first substantially pre-assembled range module includes a first gaseous fuel inlet;

the second substantially pre-assembled range module includes a second gaseous fuel inlet;

step (c) includes:

interconnecting the first gaseous fuel inlet and the second gaseous fuel inlet to provide the combined assembly with a single gaseous fuel inlet connection that feeds both gaseous fuel inlets.

* * * * *